US011705619B2

(12) United States Patent
Park et al.

(10) Patent No.: US 11,705,619 B2
(45) Date of Patent: Jul. 18, 2023

(54) ANTENNA AND ELECTRONIC DEVICE INCLUDING THE SAME

(71) Applicant: Samsung Electronics Co., Ltd., Gyeonggi-do (KR)

(72) Inventors: Seongjin Park, Gyeonggi-do (KR); Dongyeon Kim, Gyeonggi-do (KR); Hosaeng Kim, Gyeonggi-do (KR); Sumin Yun, Gyeonggi-do (KR); Woomin Jang, Gyeonggi-do (KR); Myunghun Jeong, Gyeonggi-do (KR); Jaehoon Jo, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 124 days.

(21) Appl. No.: 17/094,916

(22) Filed: Nov. 11, 2020

(65) Prior Publication Data

US 2021/0151859 A1 May 20, 2021

(30) Foreign Application Priority Data

Nov. 18, 2019 (KR) ..... 10-2019-0147902

(51) Int. Cl.
*H01Q 1/24* (2006.01)
*H01Q 3/36* (2006.01)
(Continued)

(52) U.S. Cl.
CPC ..... *H01Q 1/243* (2013.01); *H01Q 1/38* (2013.01); *H01Q 3/36* (2013.01); *H01Q 5/378* (2015.01)

(58) Field of Classification Search
CPC ..... H01Q 1/243; H01Q 1/38; H01Q 3/36; H01Q 5/378
See application file for complete search history.

(56) References Cited

U.S. PATENT DOCUMENTS 6,310,584 B1 10/2001 Reece et al.
2013/0207869 A1 8/2013 Han et al.
(Continued)

FOREIGN PATENT DOCUMENTS

KR 10-1288381 B1 7/2013
KR 10-1954819 B1 2/2019
(Continued)

OTHER PUBLICATIONS

International Search Report dated Feb. 18, 2021.

*Primary Examiner* — Dieu Hien T Duong
(74) *Attorney, Agent, or Firm* — Cha & Reiter, LLC

(57) ABSTRACT

In an embodiment, an electronic device may include a housing having an inner space and an antenna structure disposed in the inner space of the housing. The antenna structure may include a printed circuit board (PCB) and at least one antenna disposed in the PCB. The PCB may have a plurality of insulating layers and a ground layer. The at least one antenna may include a conductive line disposed on a first insulating layer among the plurality of insulating layers, a conductive via extended from the conductive line in a first direction, and at least one conductive pattern branched at a right angle from the conductive line on the first insulating layer. The wireless communication circuit may be configured to transmit and/or receive a radio signal in a range of about 3 GHz to about 100 GHz through the at least one antenna.

9 Claims, 42 Drawing Sheets

(51) Int. Cl.
*H01Q 5/378* (2015.01)
*H01Q 1/38* (2006.01)

(56) References Cited

U.S. PATENT DOCUMENTS

| | | | | |
|---|---|---|---|---|
| 2016/0043470 | A1 | 2/2016 | Ko et al. | |
| 2018/0123222 | A1 | 5/2018 | Jang et al. | |
| 2018/0248254 | A1* | 8/2018 | Islam | H01Q 19/13 |
| 2018/0294551 | A1 | 10/2018 | Ryan et al. | |
| 2018/0309230 | A1 | 10/2018 | Rezai et al. | |
| 2020/0381830 | A1 | 12/2020 | Kim et al. | |
| 2021/0119344 | A1* | 4/2021 | Nemoto | H01Q 1/48 |

FOREIGN PATENT DOCUMENTS

| | | | |
|---|---|---|---|
| KR | 10-2019-0039060 | A | 4/2019 |
| KR | 10-2019-0090441 | A | 8/2019 |

* cited by examiner

Dipole (HP)

Monopole (VP)

HP dipole

VP dipole

Dipole

Monopole (Case 1)

Monopole (Case 2)

Monopole (Case 3)

ANTENNA AND ELECTRONIC DEVICE INCLUDING THE SAME

CROSS-REFERENCE TO RELATED APPLICATION(S)

This application is based on and claims priority under 35 U.S.C. 119 to Korean Patent Application No. 10-2019-0147902, filed on Nov. 18, 2019, in the Korean Intellectual Property Office, the disclosures of which are herein incorporated by reference in their entireties.

BACKGROUND

Field

Certain embodiments of the instant disclosure generally relate to an antenna and an electronic device including the same.

Description of Related Art

With the development of wireless communication technology, electronic devices such as smart phones are widely used in everyday life, and accordingly content consumption on these devices is increasing exponentially. Due to the rapid increase in contents consumption, the demand has strained network capacity, and after the commercialization of 4th-generation (4G) communication systems, next-generation communication systems (e.g., 5th-generation (5G) communication system, pre-5G communication system, or new radio (NR) communication system) using super-high frequency (e.g., mmWave) band (e.g., 3 GHz to 300 GHz band) is now being implemented in order to satisfy the increasing demands of radio data traffic.

Next-generation wireless communication technologies are currently developed to permit signal transmission/reception using frequencies in the range of 3 GHz to 100 GHz, overcome high free space loss due to frequency characteristics, implement efficient mounting structures for increasing antenna gain, and realize related new antenna structures. The antenna structure that operates in the above operating frequency band may include, as the antenna element, at least one conductive pattern that is easy to implement high gain and polarization, and may be disposed to generally form a beam pattern in the lateral, front and/or rear direction of the electronic device.

However, recently these electronic devices have become slimmer, and thus designers are confronted with a problem in that the inner space (e.g. the internal space of the electronic device) for mounting the antenna structure is insufficient, so that it is difficult to properly dispose the antenna structure within the electronic devices.

SUMMARY

Certain embodiments of the instant disclosure provide an antenna and an electronic device including the same.

Certain embodiments of the instant disclosure provide an antenna suitable for slim electronic devices and the electronic device including the same.

According to an embodiment, an electronic device may include a housing having an inner space, an antenna structure disposed in the inner space of the housing, and a wireless communication circuit disposed in the inner space of the housing. The antenna structure may include a printed circuit board (PCB) and at least one antenna disposed in the PCB. The PCB may have a first board surface facing a first direction, a second board surface facing a second direction opposite to the first direction, a board lateral surface surrounding a space between the first and second board surfaces, a plurality of insulating layers, and a ground layer. The at least one antenna may be overlapped with the ground layer when the first board surface is viewed from above, and may form a beam pattern in a direction that the board lateral surface faces. The at least one antenna may include a conductive line disposed on a first insulating layer among the plurality of insulating layers, a conductive via extended from the conductive line in the first direction, and at least one conductive pattern branched at a right angle from the conductive line on the first insulating layer. The wireless communication circuit may be configured to transmit and/or receive a radio signal in a range of about 3 GHz to about 100 GHz through the at least one antenna.

According to an embodiment, an electronic device may include a housing having an inner space, an antenna structure disposed in the inner space of the housing, and a wireless communication circuit disposed in the inner space of the housing. The antenna structure may include a printed circuit board (PCB) and at least one first antenna disposed in the PCB. The PCB may have a first board surface facing a first direction, a second board surface facing a second direction opposite to the first direction, a board lateral surface surrounding a space between the first and second board surfaces, and a plurality of insulating layers. The at least one first antenna may form a beam pattern in a direction that the board lateral surface faces, and may include a first antenna element and a second antenna element. The first antenna element may include a first conductive line disposed on a first insulating layer among the plurality of insulating layers, a first conductive via extended from the first conductive line in the first direction, and a first conductive pattern extended from the first conductive via. The second antenna element may include a second conductive line disposed on a second insulating layer among the plurality of insulating layers, a second conductive via extended from the second conductive line in the second direction, and a second conductive pattern extended from the second conductive via. The wireless communication circuit may be configured to transmit and/or receive a radio signal of a first frequency band through the at least one first antenna.

According to an embodiment, an electronic device may include a housing having an inner space, an antenna structure disposed in the inner space of the housing, and a wireless communication circuit disposed in the inner space of the housing. The antenna structure may include a printed circuit board (PCB), a first antenna array disposed in the PCB, and a second antenna array disposed in the PCB. The PCB may have a first board surface facing a first direction, a second board surface facing a second direction opposite to the first direction, a board lateral surface surrounding a space between the first and second board surfaces, and a plurality of insulating layers. The first antenna array may include a plurality of first antennas forming a beam pattern corresponding to a first polarization in a direction that the board lateral surface faces. Each of the plurality of first antennas may include a first antenna element and a second antenna element. The first antenna element may include a first conductive line disposed on a first insulating layer among the plurality of insulating layers, a first conductive via extended from the first conductive line in the first direction, and a first conductive pattern extended from the first conductive via. The second antenna element may include a second conductive line disposed on a second insulating layer among the plurality of insulating layers, a second conductive via extended from the second conductive line in the second direction, and a second conductive pattern extended from the second conductive via. The second antenna array may include a plurality of second antennas disposed respectively between the plurality of first antennas and forming a beam pattern corresponding to a second polarization different from the first polarization in the direction that the board lateral surface faces. The wireless communication circuit may be configured to transmit and/or receive a radio signal of a first frequency band through the first antenna array and the second antenna array.

Additional aspects will be set forth in part in the description which follows and, in part, will be apparent from the description, or may be learned by practice of the presented embodiments.

BRIEF DESCRIPTION OF THE DRAWINGS

The above and other aspects, features and advantages of certain embodiments of the disclosure will be more apparent from the following detailed description, taken in conjunction with the accompanying drawings.

DETAILED DESCRIPTION

Hereinafter, embodiments of the disclosure will be described in detail with reference to the accompanying drawings.

Figure 1:
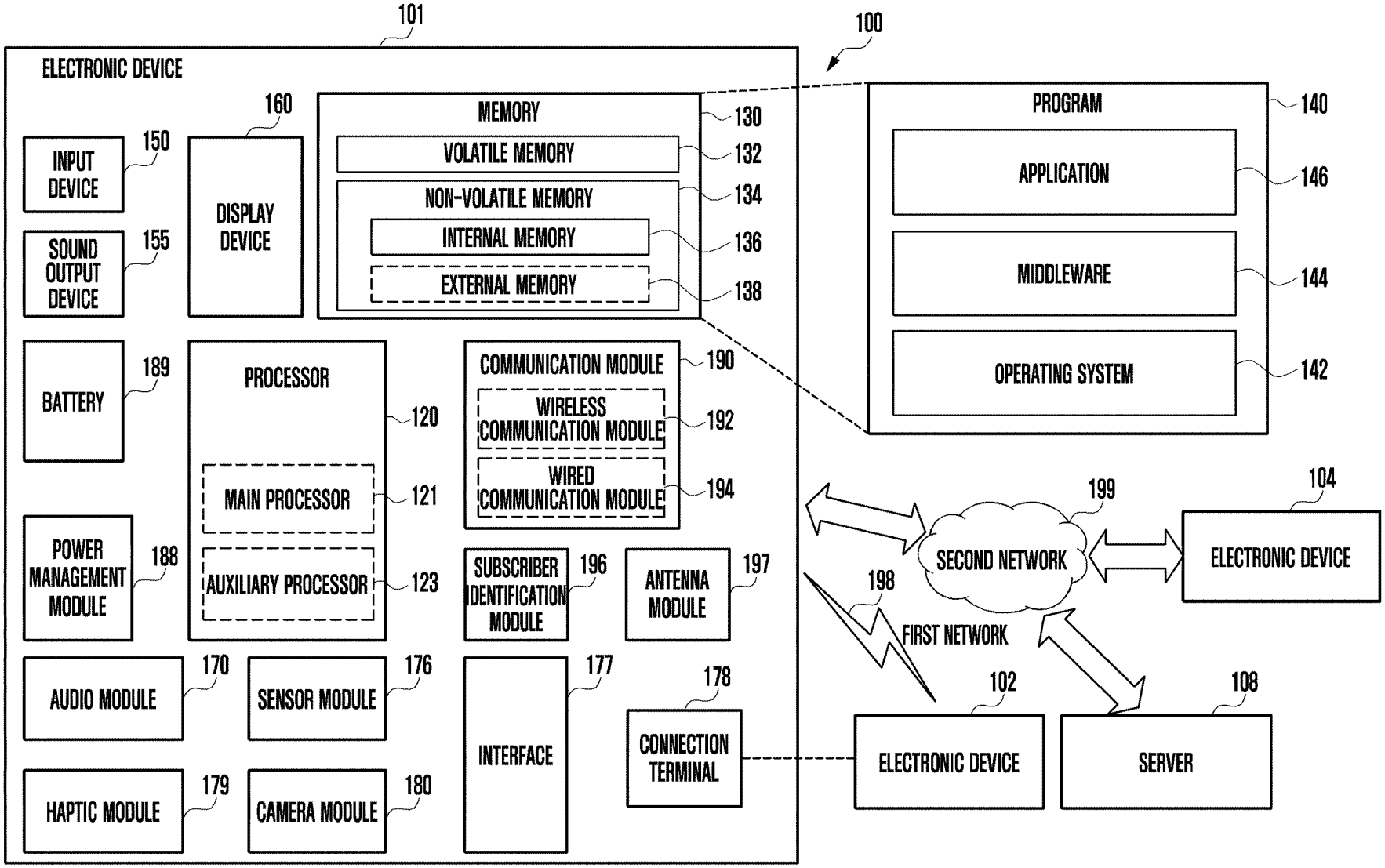
FIG. 1 is a block diagram illustrating an electronic device in a network environment according to various embodiments of the disclosure.

FIG. 1 illustrates an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). The electronic device 101 may communicate with the electronic device 104 via the server 108. The electronic device 101 includes a processor 120, memory 130, an input device 150, an audio output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. As at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. The processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). The auxiliary processor 123 (e.g., an ISP or a CP) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The audio output device 155 may output sound signals to the outside of the electronic device 101. The audio output device 155 may include, for example, a speaker or a receiver. The speaker may be used for general purposes, such as playing multimedia or playing record, and the receiver may be used for an incoming calls. The receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. The display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. The audio module 170 may obtain the sound via the input device 150, or output the sound via the audio output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. The sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. The interface 177 may include, for example, a high definition multimedia interface (HDMI), a universal serial bus (USB) interface, a secure digital (SD) card interface, or an audio interface.

A connection terminal 178 may include a connector via which the electronic device 101 may be physically connected with the external electronic device (e.g., the electronic device 102). The connection terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. The haptic module 179 may include, for example, a motor, a piezoelectric element, or an electric stimulator.

The camera module 180 may capture an image or moving images. The camera module 180 may include one or more lenses, image sensors, image signal processors, or flashes.

The power management module 188 may manage power supplied to the electronic device 101. The power management module 188 may be implemented as at least part of, for example, a power management integrated circuit (PMIC).

The battery 189 may supply power to at least one component of the electronic device 101. The battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the AP) and supports a direct (e.g., wired) communication or a wireless communication. The communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module).

A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the SIM 196.

The antenna module 197 may transmit or receive a signal or power to or from the outside (e.g., the external electronic device) of the electronic device 101. The antenna module 197 may include an antenna including a radiating element composed of a conductive material or a conductive pattern formed in or on a substrate (e.g., a printed circuit board (PCB)). The antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. Another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

Commands or data may be transmitted or received between the electronic device 101 and the external electronic device 104 via the server 108 coupled with the second network 199. Each of the electronic devices 102 and 104 may be a device of a same type as, or a different type, from the electronic device 101. All or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

An electronic device according to an embodiment may be one of various types of electronic devices. The electronic device may include a portable communication device (e.g., a smart phone), a computer device, a portable multimedia device, a portable medical device, a camera, a wearable device, or a home appliance. However, the electronic device is not limited to any of those described above.

Various embodiments of the disclosure and the terms used herein are not intended to limit the technological features set forth herein to particular embodiments and include various changes, equivalents, or replacements for a corresponding embodiment.

With regard to the description of the drawings, similar reference numerals may be used to refer to similar or related elements.

A singular form of a noun corresponding to an item may include one or more of the things, unless the relevant context clearly indicates otherwise. As used herein, each of such phrases as "A or B", "at least one of A and B", "at least one of A or B", "A, B, or C", "at least one of A, B, and C", and "at least one of A, B, or C" may include any one of, or all possible combinations of the items enumerated together in a corresponding one of the phrases.

As used herein, such terms as "1st" and "2nd", or "first" and "second" may be used to simply distinguish a corresponding component from another, and does not limit the components in other aspect (e.g., importance or order). If an element (e.g., a first element) is referred to, with or without the term "operatively" or "communicatively", as "coupled with", "coupled to", "connected with", or "connected to" another element (e.g., a second element), it means that the element may be coupled with the other element directly (e.g., wiredly), wirelessly, or via a third element.

The term "module" may include a unit implemented in hardware, software, or firmware, and may interchangeably be used with other terms, for example, "logic", "logic block", "part", or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

A method according to an embodiment of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

Each component (e.g., a module or a program) of the above-described components may include a single entity or multiple entities. One or more of the above-described components may be omitted, or one or more other components may be added. Alternatively or additionally, a plurality of components (e.g., modules or programs) may be integrated into a single component. In such a case, the integrated component may perform one or more functions of each of the plurality of components in the same or similar manner as they are performed by a corresponding one of the plurality of components before the integration. Operations performed by the module, the program, or another component may be carried out sequentially, in parallel, repeatedly, or heuristically, or one or more of the operations may be executed in a different order or omitted, or one or more other operations may be added.

Figure 2:
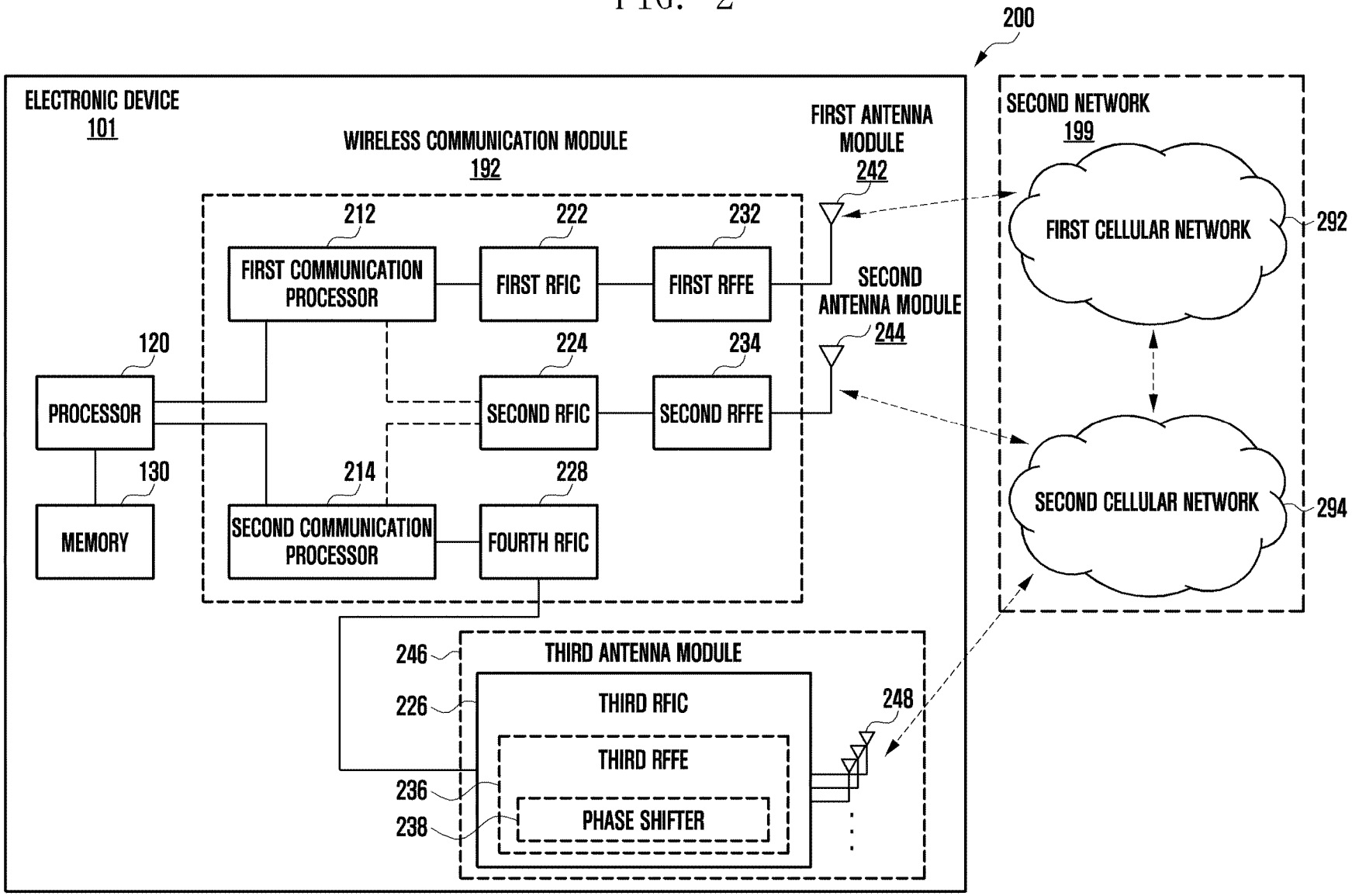
FIG. 2 is a block diagram illustrating an electronic device for supporting a legacy network communication and a 5G network communication according to various embodiments of the disclosure.

FIG. 2 is a block diagram illustrating an electronic device in a network environment including a plurality of cellular networks according to an embodiment of the disclosure.

Referring to FIG. 2, the electronic device 101 may include a first communication processor 212, second communication processor 214, first RFIC 222, second RFIC 224, third RFIC 226, fourth RFIC 228, first radio frequency front end (RFFE) 232, second RFFE 234, first antenna module 242, second antenna module 244, and antenna 248. The electronic device 101 may include a processor 120 and a memory 130. A second network 199 may include a first cellular network 292 and a second cellular network 294. According to another embodiment, the electronic device 101 may further include at least one of the components described with reference to FIG. 1, and the second network 199 may further include at least one other network. According to one embodiment, the first communication processor 212, second communication processor 214, first RFIC 222, second RFIC 224, fourth RFIC 228, first RFFE 232, and second RFFE 234 may form at least part of the wireless communication module 192. According to another embodiment, the fourth RFIC 228 may be omitted or included as part of the third RFIC 226.

The first communication processor 212 may establish a communication channel of a band to be used for wireless communication with the first cellular network 292 and support legacy network communication through the established communication channel. According to various embodiments, the first cellular network may be a legacy network including a second generation (2G), 3G, 4G, or long term evolution (LTE) network. The second communication processor 214 may establish a communication channel corresponding to a designated band (e.g., about 6 GHz to about 60 GHz) of bands to be used for wireless communication with the second cellular network 294, and support 5G network communication through the established communication channel. According to various embodiments, the second cellular network 294 may be a 5G network defined in 3GPP. Additionally, according to an embodiment, the first communication processor 212 or the second communication processor 214 may establish a communication channel corresponding to another designated band (e.g., about 6 GHz or less) of bands to be used for wireless communication with the second cellular network 294 and support 5G network communication through the established communication channel. According to one embodiment, the first communication processor 212 and the second communication processor 214 may be implemented in a single chip or a single package. According to various embodiments, the first communication processor 212 or the second communication processor 214 may be formed in a single chip or a single package with the processor 120, the auxiliary processor 123, or the communication module 190.

Upon transmission, the first RFIC 222 may convert a baseband signal generated by the first communication processor 212 to a radio frequency (RF) signal of about 700 MHz to about 3 GHz used in the first cellular network 292 (e.g., legacy network). Upon reception, an RF signal may be obtained from the first cellular network 292 (e.g., legacy network) through an antenna (e.g., the first antenna module 242) and be preprocessed through an RFFE (e.g., the first RFFE 232). The first RFIC 222 may convert the preprocessed RF signal to a baseband signal so as to be processed by the first communication processor 212.

Upon transmission, the second RFIC 224 may convert a baseband signal generated by the first communication processor 212 or the second communication processor 214 to an RF signal (hereinafter, 5G Sub6 RF signal) of a Sub6 band (e.g., 6 GHz or less) to be used in the second cellular network 294 (e.g., 5G network). Upon reception, a 5G Sub6 RF signal may be obtained from the second cellular network 294 (e.g., 5G network) through an antenna (e.g., the second antenna module 244) and be pretreated through an RFFE (e.g., the second RFFE 234). The second RFIC 224 may convert the preprocessed 5G Sub6 RF signal to a baseband signal so as to be processed by a corresponding communication processor of the first communication processor 212 or the second communication processor 214.

The third RFIC 226 may convert a baseband signal generated by the second communication processor 214 to an RF signal (hereinafter, 5G Above6 RF signal) of a 5G Above6 band (e.g., about 6 GHz to about 60 GHz) to be used in the second cellular network 294 (e.g., 5G network). Upon reception, a 5G Above6 RF signal may be obtained from the second cellular network 294 (e.g., 5G network) through an antenna (e.g., the antenna 248) and be preprocessed through the third RFFE 236. The third RFIC 226 may convert the preprocessed 5G Above6 RF signal to a baseband signal so as to be processed by the second communication processor 214. According to one embodiment, the third RFFE 236 may be formed as part of the third RFIC 226.

According to an embodiment, the electronic device 101 may include a fourth RFIC 228 separately from the third RFIC 226 or as at least part of the third RFIC 226. In this case, the fourth RFIC 228 may convert a baseband signal generated by the second communication processor 214 to an RF signal (hereinafter, an intermediate frequency (IF) signal) of an intermediate frequency band (e.g., about 9 GHz to about 11 GHz) and transfer the IF signal to the third RFIC 226. The third RFIC 226 may convert the IF signal to a 5G Above 6RF signal. Upon reception, the 5G Above 6RF signal may be received from the second cellular network 294 (e.g., a 5G network) through an antenna (e.g., the antenna 248) and be converted to an IF signal by the third RFIC 226. The fourth RFIC 228 may convert an IF signal to a baseband signal so as to be processed by the second communication processor 214.

According to one embodiment, the first RFIC 222 and the second RFIC 224 may be implemented into at least part of a single package or a single chip. According to one embodiment, the first RFFE 232 and the second RFFE 234 may be implemented into at least part of a single package or a single chip. According to one embodiment, at least one of the first antenna module 242 or the second antenna module 244 may be omitted or may be combined with another antenna module to process RF signals of a corresponding plurality of bands.

According to one embodiment, the third RFIC 226 and the antenna 248 may be disposed at the same substrate to form a third antenna module 246. For example, the wireless communication module 192 or the processor 120 may be disposed at a first substrate (e.g., main PCB). In this case, the third RFIC 226 is disposed in a partial area (e.g., lower surface) of the first substrate and a separate second substrate (e.g., sub PCB), and the antenna 248 is disposed in another partial area (e.g., upper surface) thereof; thus, the third antenna module 246 may be formed. By disposing the third RFIC 226 and the antenna 248 in the same substrate, a length of a transmission line therebetween can be reduced. This may reduce, for example, a loss (e.g., attenuation) of a signal of a high frequency band (e.g., about 6 GHz to about 60 GHz) to be used in 5G network communication by a transmission line. Therefore, the electronic device 101 may improve a quality or speed of communication with the second cellular network 294 (e.g., 5G network).

According to one embodiment, the antenna 248 may be formed in an antenna array including a plurality of antenna elements that may be used for beamforming. In this case, the third RFIC 226 may include a plurality of phase shifters 238 corresponding to a plurality of antenna elements, for example, as part of the third RFFE 236. Upon transmission, each of the plurality of phase shifters 238 may convert a phase of a 5G Above6 RF signal to be transmitted to the outside (e.g., a base station of a 5G network) of the electronic device 101 through a corresponding antenna element. Upon reception, each of the plurality of phase shifters 238 may convert a phase of the 5G Above6 RF signal received from the outside to the same phase or substantially the same phase through a corresponding antenna element. This enables transmission or reception through beamforming between the electronic device 101 and the outside.

The second cellular network 294 (e.g., 5G network) may operate (e.g., stand-alone (SA)) independently of the first cellular network 292 (e.g., legacy network) or may be operated (e.g., non-stand alone (NSA)) in connection with the first cellular network 292. For example, the 5G network may have only an access network (e.g., 5G radio access network (RAN) or a next generation (NG) RAN and have no core network (e.g., next generation core (NGC)). In this case, after accessing to the access network of the 5G network, the electronic device 101 may access to an external network (e.g., Internet) under the control of a core network (e.g., an evolved packed core (EPC)) of the legacy network. Protocol information (e.g., LTE protocol information) for communication with a legacy network or protocol information (e.g., new radio (NR) protocol information) for communication with a 5G network may be stored in the memory 130 to be accessed by other components (e.g., the processor 120, the first communication processor 212, or the second communication processor 214).

Figure 3A:
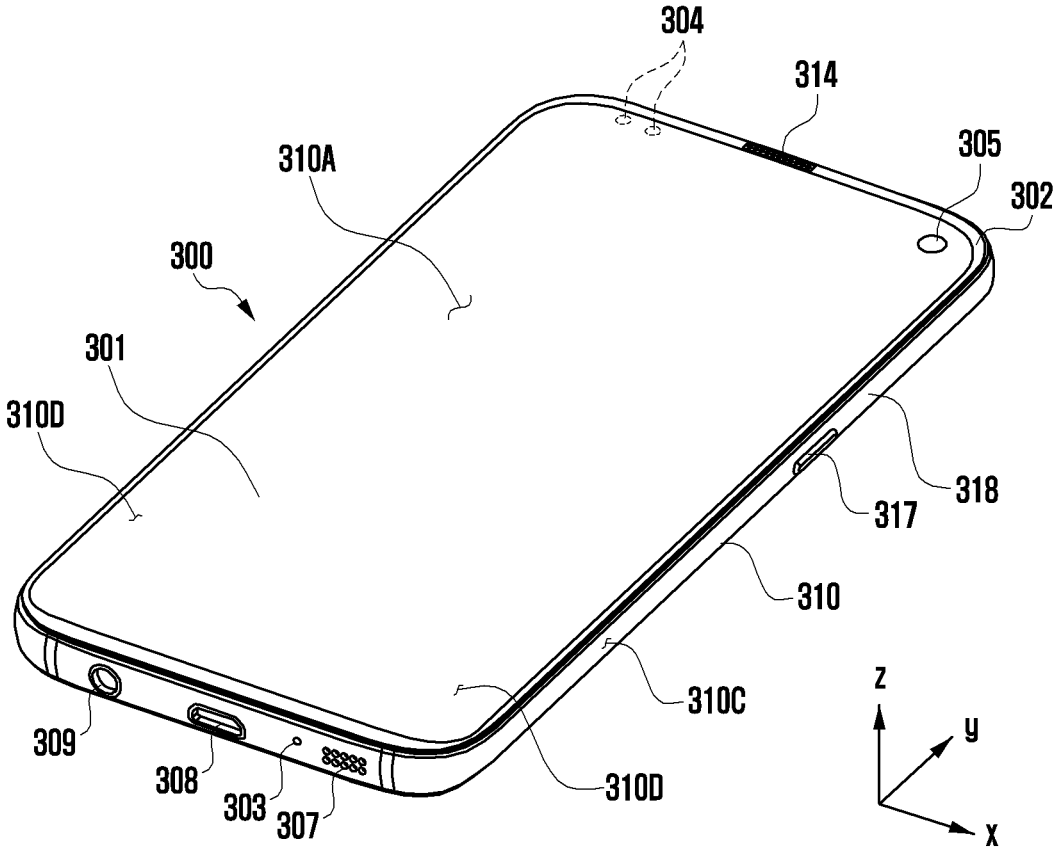
FIG. 3A is a perspective view illustrating a front surface of a mobile electronic device according to various embodiments of the disclosure.
Figure 3B:
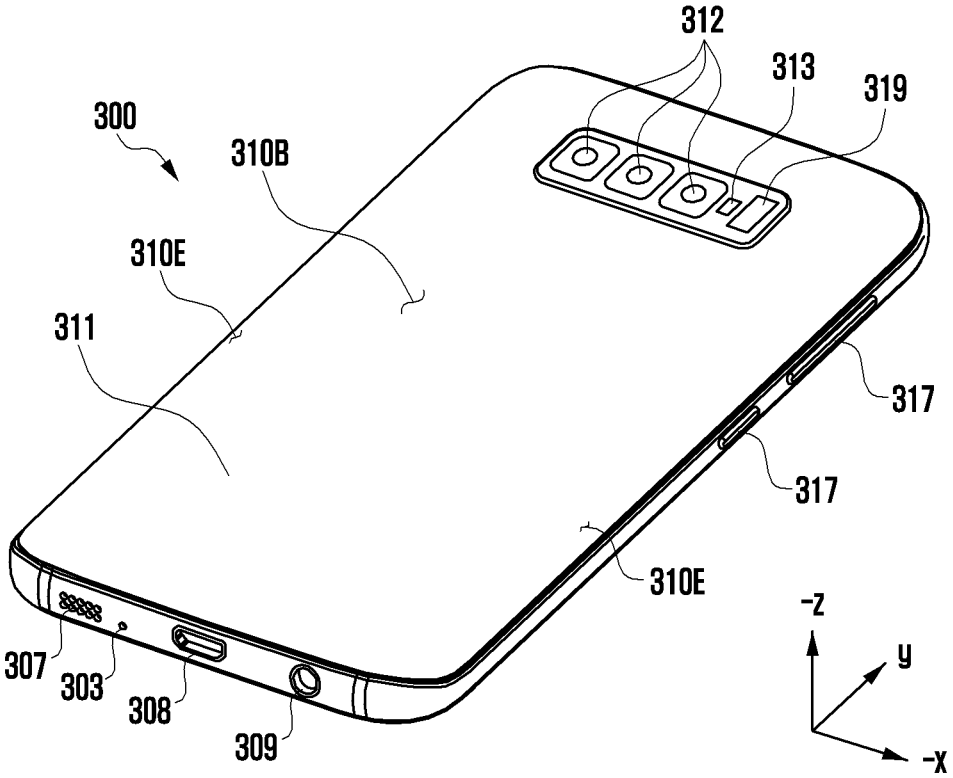
FIG. 3B is a perspective view illustrating a rear surface of the mobile electronic device shown in FIG. 3A.

FIG. 3A illustrates a perspective view showing a front surface of a mobile electronic device according to an embodiment of the disclosure, and FIG. 3B illustrates a perspective view showing a rear surface of the mobile electronic device shown in FIG. 3A according to an embodiment of the disclosure.

Referring to FIGS. 3A and 3B, a mobile electronic device 300 may include a housing 310 that includes a first surface (or front surface) 310A, a second surface (or rear surface) 310B, and a lateral surface 310C that surrounds a space between the first surface 310A and the second surface 310B. The housing 310 may refer to a structure that forms a part of the first surface 310A, the second surface 310B, and the lateral surface 310C. The first surface 310A may be formed of a front plate 302 (e.g., a glass plate or polymer plate coated with a variety of coating layers) at least a part of which is substantially transparent. The second surface 310B may be formed of a rear plate 311 which is substantially opaque. The rear plate 311 may be formed of, for example, coated or colored glass, ceramic, polymer, metal (e.g., aluminum, stainless steel (STS), or magnesium), or any combination thereof. The lateral surface 310C may be formed of a lateral bezel structure (or "lateral member") 318 which is combined with the front plate 302 and the rear plate 311 and includes a metal and/or polymer. The rear plate 311 and the lateral bezel structure 318 may be integrally formed and may be of the same material (e.g., a metallic material such as aluminum).

The front plate 302 may include two first regions 310D disposed at long edges thereof, respectively, and bent and extended seamlessly from the first surface 310A toward the rear plate 311. Similarly, the rear plate 311 may include two second regions 310E disposed at long edges thereof, respectively, and bent and extended seamlessly from the second surface 310B toward the front plate 302. The front plate 302 (or the rear plate 311) may include only one of the first regions 310D (or of the second regions 310E). The first regions 310D or the second regions 310E may be omitted in part. When viewed from a lateral side of the mobile electronic device 300, the lateral bezel structure 318 may have a first thickness (or width) on a lateral side where the first region 310D or the second region 310E is not included, and may have a second thickness, being less than the first thickness, on another lateral side where the first region 310D or the second region 310E is included.

The mobile electronic device 300 may include at least one of a display 301, audio modules 303, 307 and 314, sensor modules 304 and 319, camera modules 305, 312 and 313, a key input device 317, a light emitting device, and connector holes 308 and 309. The mobile electronic device 300 may omit at least one (e.g., the key input device 317 or the light emitting device) of the above components, or may further include other components.

The display 301 may be exposed through a substantial portion of the front plate 302, for example. At least a part of the display 301 may be exposed through the front plate 302 that forms the first surface 310A and the first region 310D of the lateral surface 310C. Outlines (i.e., edges and corners) of the display 301 may have substantially the same form as those of the front plate 302. The spacing between the outline of the display 301 and the outline of the front plate 302 may be substantially unchanged in order to enlarge the exposed area of the display 301.

A recess or opening may be formed in a portion of a display area of the display 301 to accommodate at least one of the audio module 314, the sensor module 304, the camera module 305, and the light emitting device. At least one of the audio module 314, the sensor module 304, the camera module 305, a fingerprint sensor (not shown), and the light emitting element may be disposed on the back of the display area of the display 301. The display 301 may be combined with, or adjacent to, a touch sensing circuit, a pressure sensor capable of measuring the touch strength (pressure), and/or a digitizer for detecting a stylus pen. At least a part of the sensor modules 304 and 319 and/or at least a part of the key input device 317 may be disposed in the first region 310D and/or the second region 310E.

The audio modules 303, 307 and 314 may correspond to a microphone hole 303 and speaker holes 307 and 314, respectively. The microphone hole 303 may contain a microphone disposed therein for acquiring external sounds and, in a case, contain a plurality of microphones to sense a sound direction. The speaker holes 307 and 314 may be classified into an external speaker hole 307 and a call receiver hole 314. The microphone hole 303 and the speaker holes 307 and 314 may be implemented as a single hole, or a speaker (e.g., a piezo speaker) may be provided without the speaker holes 307 and 314.

The sensor modules 304 and 319 may generate electrical signals or data corresponding to an internal operating state of the mobile electronic device 300 or to an external environmental condition. The sensor modules 304 and 319 may include a first sensor module 304 (e.g., a proximity sensor) and/or a second sensor module (e.g., a fingerprint sensor) disposed on the first surface 310A of the housing 310, and/or a third sensor module 319 (e.g., a heart rate monitor (HRM) sensor) and/or a fourth sensor module (e.g., a fingerprint sensor) disposed on the second surface 310B of the housing 310. The fingerprint sensor may be disposed on the second surface 310B as well as the first surface 310A (e.g., the display 301) of the housing 310. The electronic device 300 may further include at least one of a gesture sensor, a gyro sensor, an air pressure sensor, a magnetic sensor, an acceleration sensor, a grip sensor, a color sensor, an infrared (IR) sensor, a biometric sensor, a temperature sensor, a humidity sensor, or an illuminance sensor.

The camera modules 305, 312 and 313 may include a first camera device 305 disposed on the first surface 310A of the electronic device 300, and a second camera module 312 and/or a flash 313 disposed on the second surface 310B. The camera module 305 or the camera module 312 may include one or more lenses, an image sensor, and/or an image signal processor. The flash 313 may include, for example, a light emitting diode or a xenon lamp. Two or more lenses (infrared cameras, wide angle and telephoto lenses) and image sensors may be disposed on one side of the electronic device 300.

The key input device 317 may be disposed on the lateral surface 310C of the housing 310. The mobile electronic device 300 may not include some or all of the key input device 317 described above, and the key input device 317 which is not included may be implemented in another form such as a soft key on the display 301. The key input device 317 may include the sensor module disposed on the second surface 310B of the housing 310.

The light emitting device may be disposed on the first surface 310A of the housing 310. For example, the light emitting device may provide status information of the electronic device 300 in an optical form. The light emitting device may provide a light source associated with the operation of the camera module 305. The light emitting device may include, for example, a light emitting diode (LED), an IR LED, or a xenon lamp.

The connector holes 308 and 309 may include a first connector hole 308 adapted for a connector (e.g., a universal serial bus (USB) connector) for transmitting and receiving power and/or data to and from an external electronic device, and/or a second connector hole 309 adapted for a connector (e.g., an earphone jack) for transmitting and receiving an audio signal to and from an external electronic device.

Some modules 305 of camera modules 305 and 312, some sensor modules 304 of sensor modules 304 and 319, or an indicator may be arranged to be exposed through a display 301. For example, the camera module 305, the sensor module 304, or the indicator may be arranged in the internal space of an electronic device 300 so as to be brought into contact with an external environment through an opening of the display 301, which is perforated up to a front plate 302. In another embodiment, some sensor modules 304 may be arranged to perform their functions without being visually exposed through the front plate 302 in the internal space of the electronic device. For example, in this case, an area of the display 301 facing the sensor module may not require a perforated opening.

Figure 3C:
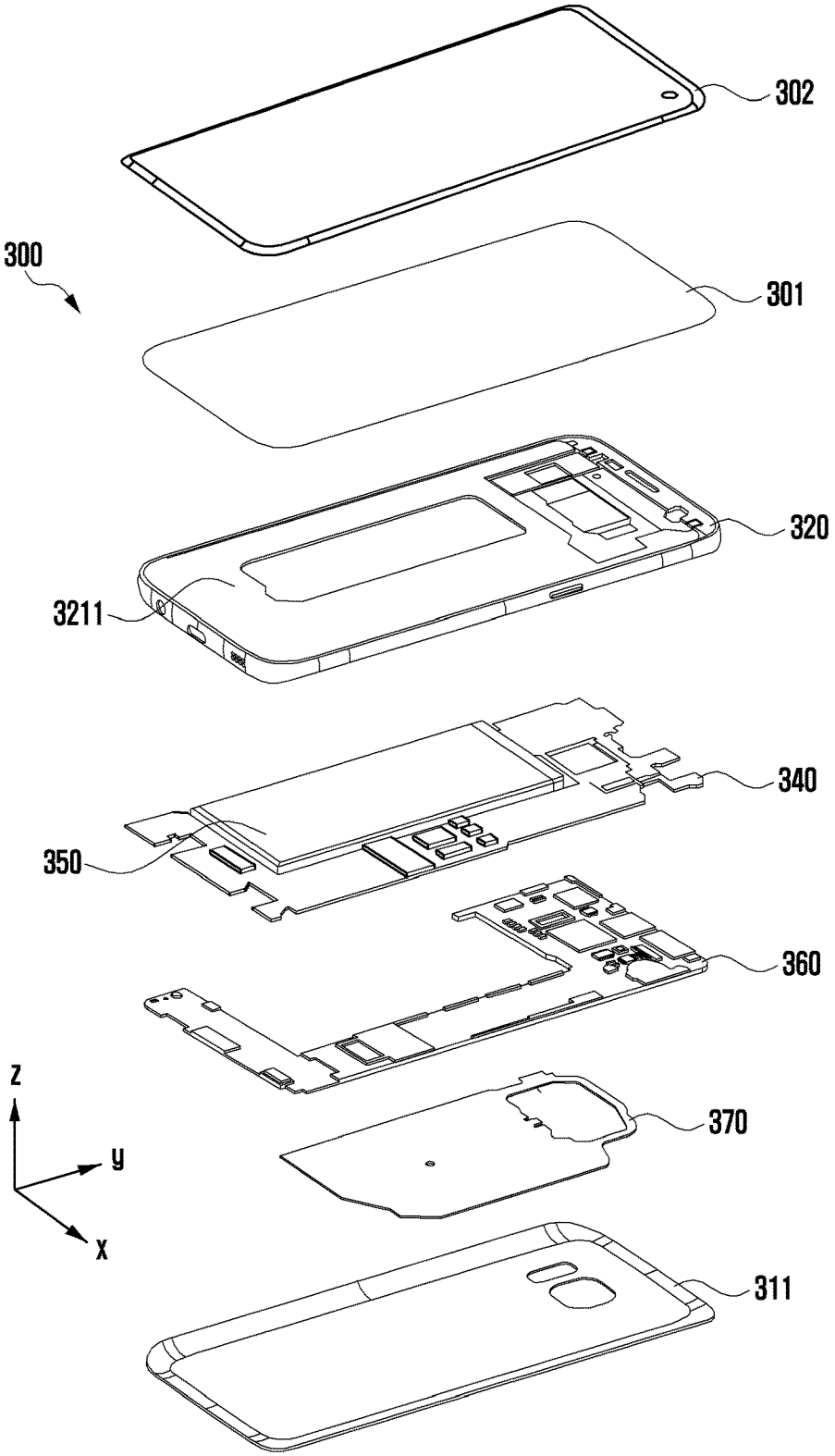
FIG. 3C is an exploded perspective view illustrating the mobile electronic device shown in FIGS. 3A and 3B.

FIG. 3C illustrates an exploded perspective view showing a mobile electronic device shown in FIG. 3A according to an embodiment of the disclosure.

Referring to FIG. 3C a mobile electronic device 300 may include a lateral bezel structure 320, a first support member 3211 (e.g., a bracket), a front plate 302, a display 301, an electromagnetic induction panel (not shown), a printed circuit board (PCB) 340, a battery 350, a second support member 360 (e.g., a rear case), an antenna 370, and a rear plate 311. The mobile electronic device 300 may omit at least one (e.g., the first support member 3211 or the second support member 360) of the above components or may further include another component. Some components of the electronic device 300 may be the same as or similar to those of the mobile electronic device 101 shown in FIG. 1 or FIG. 2, thus, descriptions thereof are omitted below.

The first support member 3211 is disposed inside the mobile electronic device 300 and may be connected to, or integrated with, the lateral bezel structure 320. The first support member 3211 may be formed of, for example, a metallic material and/or a non-metal (e.g., polymer) material. The first support member 3211 may be combined with the display 301 at one side thereof and also combined with the printed circuit board (PCB) 340 at the other side thereof. On the PCB 340, a processor, a memory, and/or an interface may be mounted. The processor may include, for example, one or more of a central processing unit (CPU), an application processor (AP), a graphics processing unit (GPU), an image signal processor (ISP), a sensor hub processor, or a communications processor (CP).

The memory may include, for example, one or more of a volatile memory and a non-volatile memory.

The interface may include, for example, a high definition multimedia interface (HDMI), a USB interface, a secure digital (SD) card interface, and/or an audio interface. The interface may electrically or physically connect the mobile electronic device 300 with an external electronic device and may include a USB connector, an SD card/multimedia card (MMC) connector, or an audio connector.

The battery 350 is a device for supplying power to at least one component of the mobile electronic device 300, and may include, for example, a non-rechargeable primary battery, a rechargeable secondary battery, or a fuel cell. At least a part of the battery 350 may be disposed on substantially the same plane as the PCB 340. The battery 350 may be integrally disposed within the mobile electronic device 300, and may be detachably disposed from the mobile electronic device 300.

The antenna 370 may be disposed between the rear plate 311 and the battery 350. The antenna 370 may include, for example, a near field communication (NFC) antenna, a wireless charging antenna, and/or a magnetic secure transmission (MST) antenna. The antenna 370 may perform short-range communication with an external device, or transmit and receive power required for charging wirelessly. An antenna structure may be formed by a part or combination of the lateral bezel structure 320 and/or the first support member 3211.

Figure 4A:
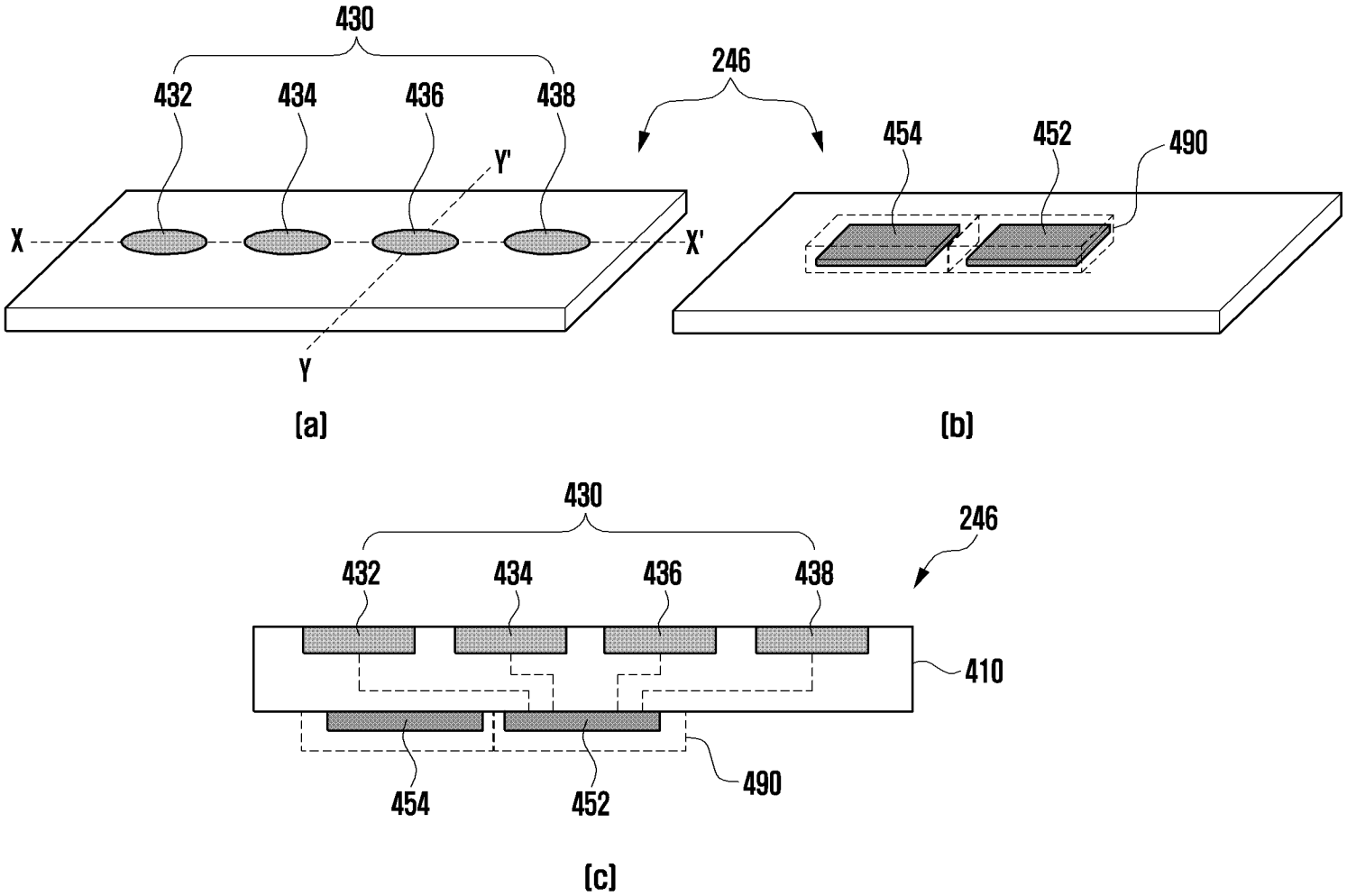
FIG. 4A is a diagram illustrating an embodiment of a structure of the third antenna module shown in and described with reference to FIG. 2.

FIG. 4A is a diagram illustrating a structure of, for example, a third antenna module described with reference to FIG. 2 according to an embodiment of the disclosure.

Referring to FIG. 4A(a) is a perspective view illustrating the third antenna module 246 viewed from one side, and FIG. 4A(b) is a perspective view illustrating the third antenna module 246 viewed from the other side. FIG. 4A(c) is a cross-sectional view illustrating the third antenna module 246 taken along line X-X' of FIG. 4A.

With reference to FIG. 4A, in one embodiment, the third antenna module 246 may include a printed circuit board 410, an antenna array 430, a RFIC 452, and a PMIC 454. Alternatively, the third antenna module 246 may further include a shield member 490. In other embodiments, at least one of the above-described components may be omitted or at least two of the components may be integrally formed.

The printed circuit board 410 may include a plurality of conductive layers and a plurality of non-conductive layers stacked alternately with the conductive layers. The printed circuit board 410 may provide electrical connections between the printed circuit board 410 and/or various electronic components disposed outside using wirings and conductive vias formed in the conductive layer.

The antenna array 430 (e.g., 248 of FIG. 2) may include a plurality of antenna elements 432, 434, 436, or 438 disposed to form a directional beam. As illustrated, the antenna elements 432, 434, 436, or 438 may be formed at a first surface of the printed circuit board 410. According to another embodiment, the antenna array 430 may be formed inside the printed circuit board 410. According to the embodiment, the antenna array 430 may include the same or a different shape or kind of a plurality of antenna arrays (e.g., dipole antenna array and/or patch antenna array).

The RFIC 452 (e.g., the third RFIC 226 of FIG. 2) may be disposed at another area (e.g., a second surface opposite to the first surface) of the printed circuit board 410 spaced apart from the antenna array. The RFIC 452 is configured to process signals of a selected frequency band transmitted/received through the antenna array 430. According to one embodiment, upon transmission, the RFIC 452 may convert a baseband signal obtained from a communication processor (not shown) to an RF signal of a designated band. Upon reception, the RFIC 452 may convert an RF signal received through the antenna array 430 to a baseband signal and transfer the baseband signal to the communication processor.

According to another embodiment, upon transmission, the RFIC 452 may up-convert an IF signal (e.g., about 9 GHz to about 11 GHz) obtained from an intermediate frequency integrate circuit (IFIC) (e.g., 228 of FIG. 2) to an RF signal of a selected band. Upon reception, the RFIC 452 may down-convert the RF signal obtained through the antenna array 430, convert the RF signal to an IF signal, and transfer the IF signal to the IFIC.

The PMIC 454 may be disposed in another partial area (e.g., the second surface) of the printed circuit board 410 spaced apart from the antenna array 430. The PMIC 454 may receive a voltage from a main PCB (not illustrated) to provide power necessary for various components (e.g., the RFIC 452) on the antenna module.

The shielding member 490 may be disposed at a portion (e.g., the second surface) of the printed circuit board 410 so as to electromagnetically shield at least one of the RFIC 452 or the PMIC 454. According to one embodiment, the shield member 490 may include a shield can.

Although not shown, in various embodiments, the third antenna module 246 may be electrically connected to another printed circuit board (e.g., main circuit board) through a module interface. The module interface may include a connecting member, for example, a coaxial cable connector, board to board connector, interposer, or flexible printed circuit board (FPCB). The RFIC 452 and/or the PMIC 454 of the antenna module may be electrically connected to the printed circuit board through the connection member.

Figure 4B:
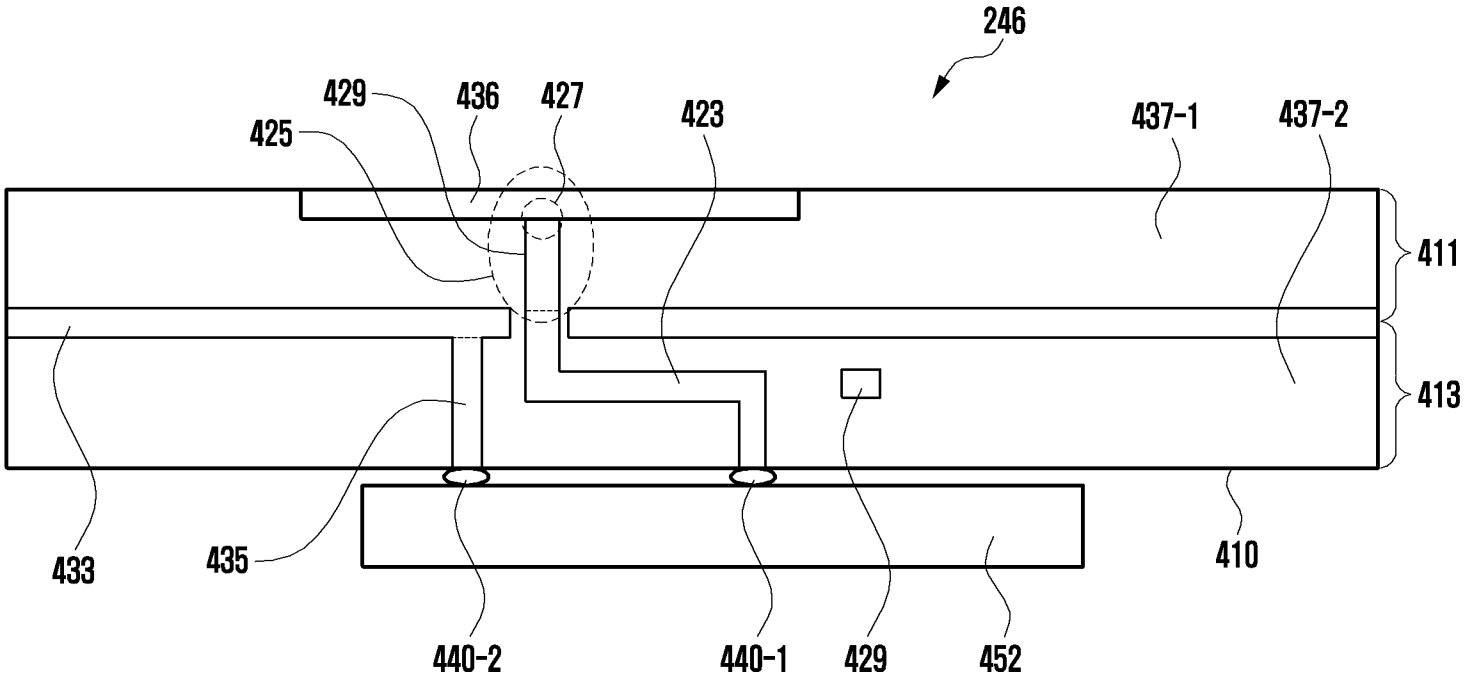
FIG. 4B is a cross-sectional view taken along the line Y-Y' in FIG. 4A.

FIG. 4B is a cross-sectional view illustrating the third antenna module 246 taken along line Y-Y' of FIG. 4A according to an embodiment of the disclosure. The printed circuit board 410 of the illustrated embodiment may include an antenna layer 411 and a network layer 413.

Referring to FIG. 4B, the antenna layer 411 may include at least one dielectric layer 437-1, and an antenna element 436 and/or a power feeding portion 425 formed on or inside an outer surface of a dielectric layer. The power feeding portion 425 may include a power feeding point 427 and/or a power feeding line 429.

The network layer 413 may include at least one dielectric layer 437-2, at least one ground layer 433, at least one conductive via 435, a transmission line 423, and/or a power feeding line 429 formed on or inside an outer surface of the dielectric layer.

Further, in the illustrated embodiment, the RFIC 452 (e.g., the third RFIC 226 of FIG. 2) of FIG. 4A(c) may be electrically connected to the network layer 413 through, for example, first and second solder bumps 440-1 and 440-2. In other embodiments, various connection structures (e.g., solder or ball grid array (BGA)) instead of the solder bumps may be used. The RFIC 452 may be electrically connected to the antenna element 436 through the first solder bump 440-1, the transmission line 423, and the power feeding portion 425. The RFIC 452 may also be electrically connected to the ground layer 433 through the second solder bump 440-2 and the conductive via 435. Although not illustrated, the RFIC 452 may also be electrically connected to the above-described module interface through the power feeding line 429.

Figure 5A:
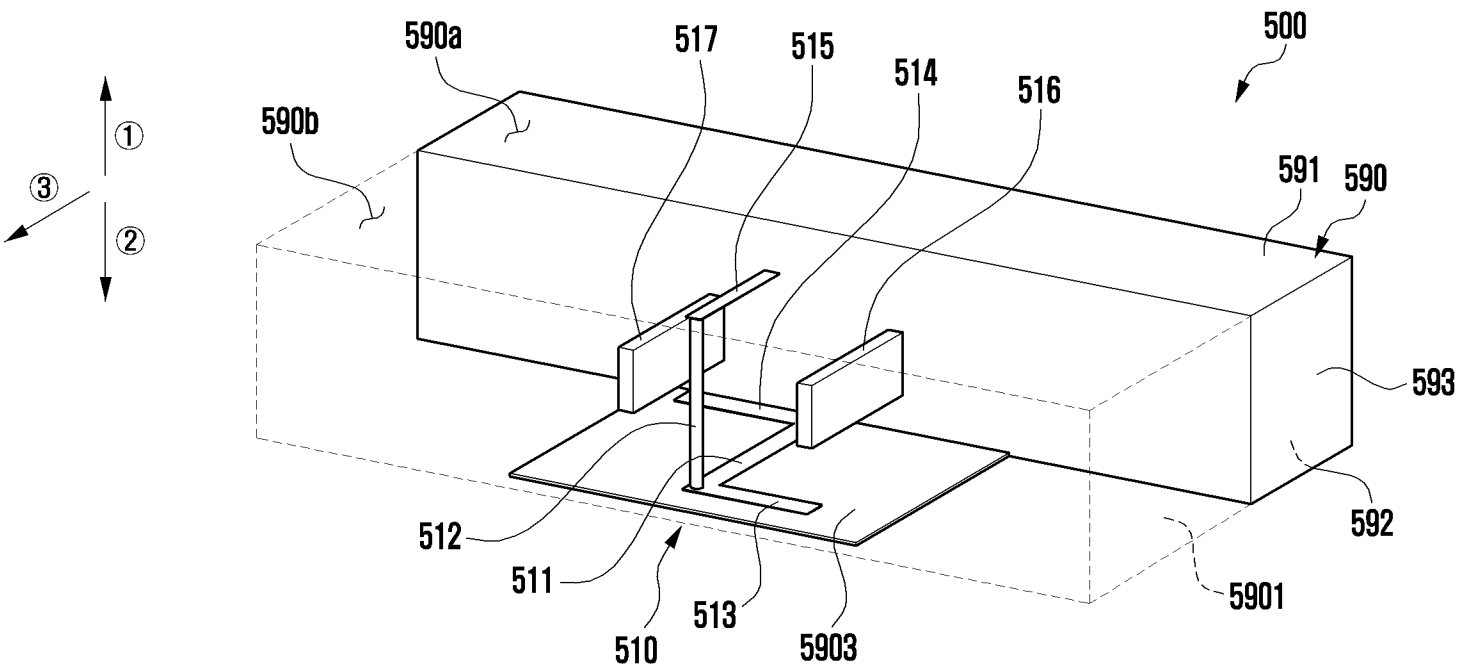
FIG. 5A is a perspective view illustrating an antenna structure according to an embodiment of the disclosure.
Figure 5B:
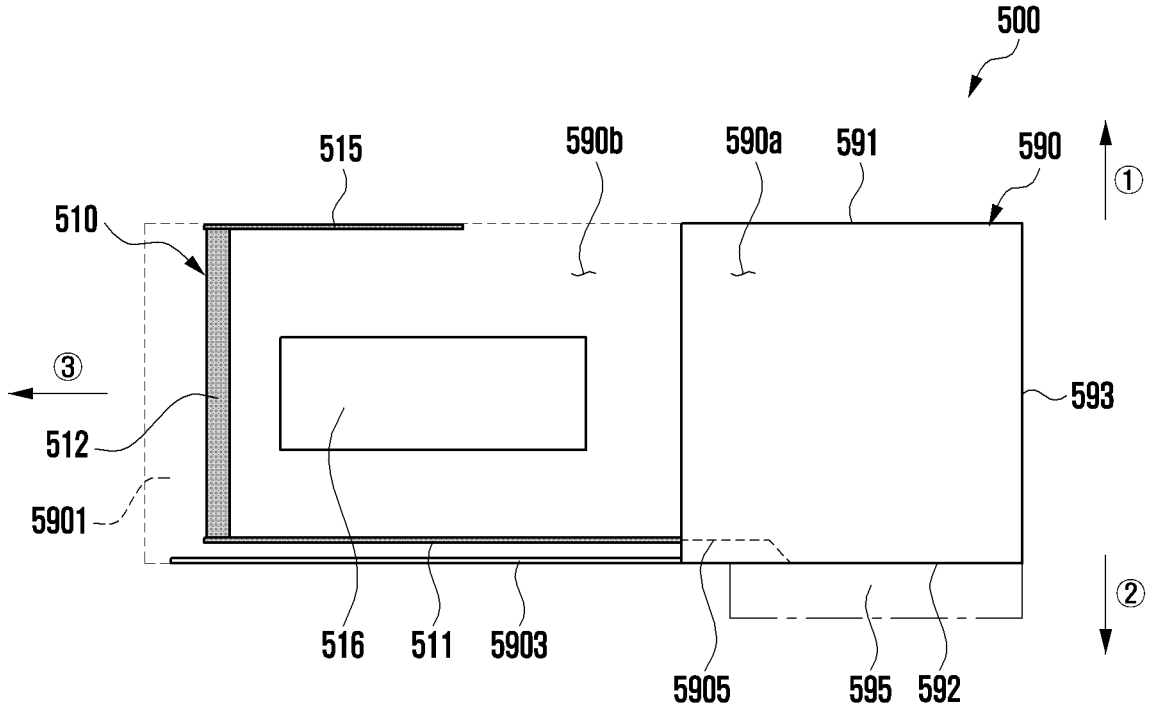
FIG. 5B is a side view illustrating the antenna structure of FIG. 5A according to an embodiment of the disclosure.
Figure 5C:
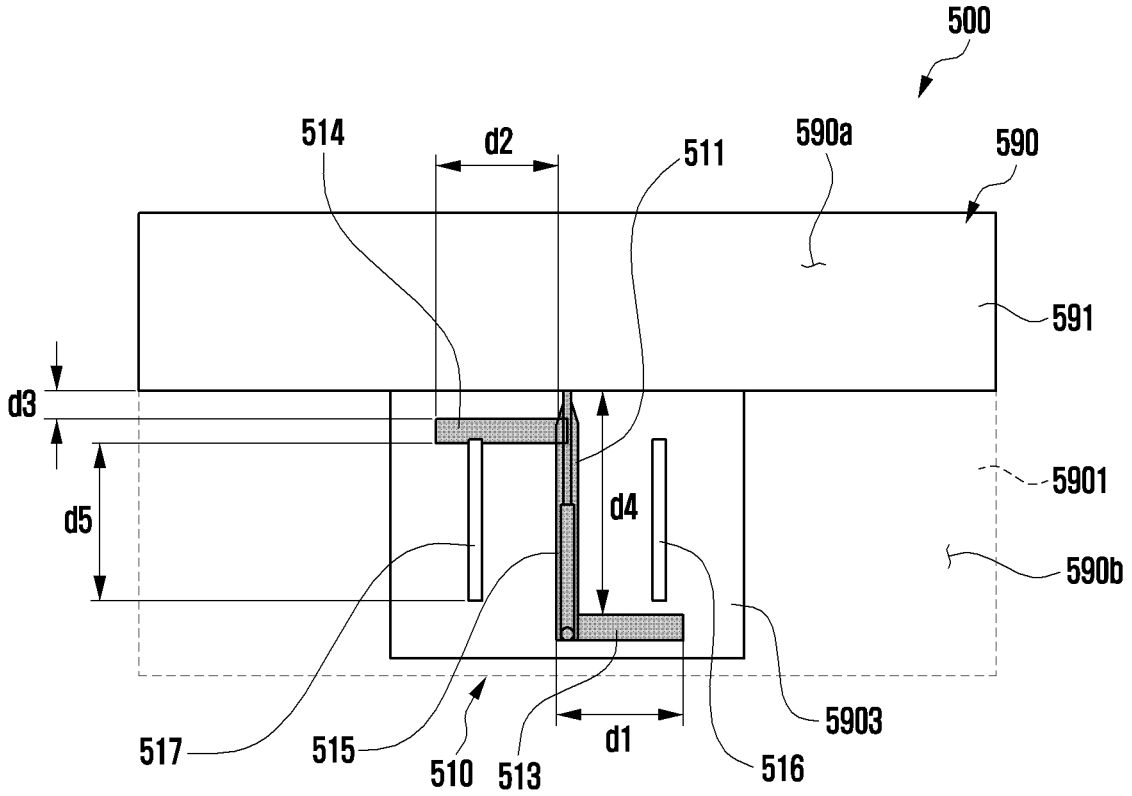
FIG. 5C is a plan view illustrating the antenna structure of FIG. 5A according to an embodiment of the disclosure.
Figure 5D:
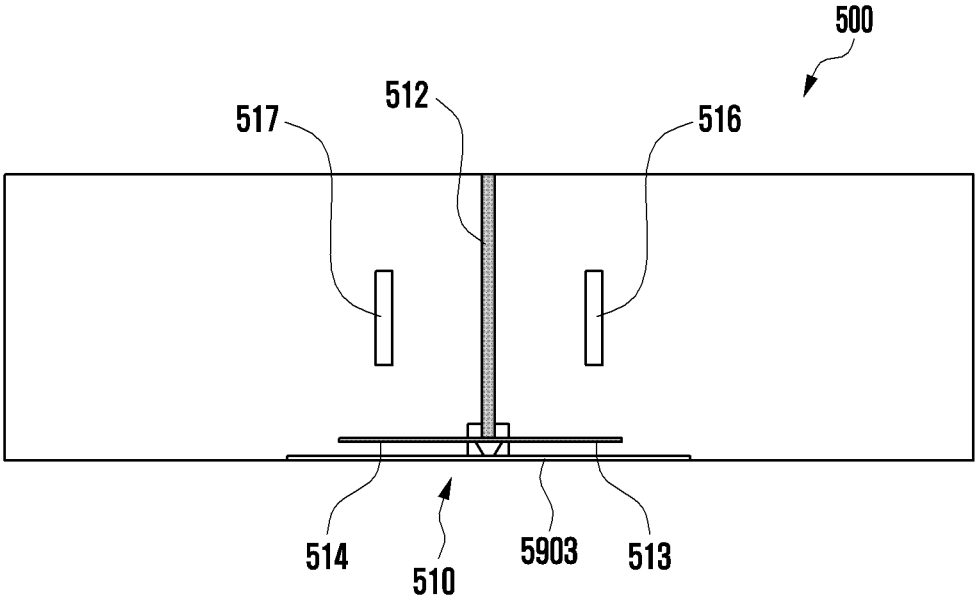
FIG. 5D is a front view illustrating the antenna structure of FIG. 5A according to an embodiment of the disclosure.

FIG. 5A is a perspective view illustrating an antenna structure 500 according to an embodiment of the disclosure. FIG. 5B is a side view illustrating the antenna structure 500 of FIG. 5A according to an embodiment of the disclosure. FIG. 5C is a plan view illustrating the antenna structure 500 of FIG. 5A according to an embodiment of the disclosure. FIG. 5D is a front view illustrating the antenna structure 500 of FIG. 5A according to an embodiment of the disclosure.

The antenna structure 500 shown in FIGS. 5A to 5D may be similar, at least in part, to the third antenna module 246 of FIG. 2, or may include other embodiments of the antenna structure.

Referring to FIGS. 5A to 5D, the antenna structure 500 may include a printed circuit board (PCB) 590 and an antenna 510 disposed in the PCB 590. According to an embodiment, the PCB 590 may have a first board surface 591 facing a first direction (denoted by ①) (e.g., the negative Z-axis direction in FIG. 3B), a second board surface 592 facing a second direction (denoted by ②) (e.g., the Z-axis direction in FIG. 3A) opposite to the first direction, and a board lateral surface 593 surrounding an inner space between the first and second board surfaces 591 and 592. According to an embodiment, the first antenna array AR1 may include a plurality of conductive patterns 510, 520, 530, and 540, as a first antenna elements, disposed at regular intervals in the inner space between the first and second board surfaces 591 and 592 of the PCB 590. AR1 including the plurality of conductive patterns 510, 520, 530, and 540 are shown in detail in FIG. 8. For simplicity of illustration, only conductive pattern 510 in shown in FIGS. 5A-5D. Herein, conductive patterns may also be referred to as antennas. According to an embodiment, the antenna structure 500 may further include a wireless communication circuit 595 disposed on the second board surface 592 of the PCB 590. According to an embodiment, the PCB 590 may be composed of a board zone 590*a* and an antenna zone 590*b* extended from the board zone 590*a* to be used for accommodating the antenna 510. According to an embodiment, the antenna zone 590*b* may have a fill-and-cut region formed by a plurality of insulating layers 5901 (e.g., dielectric layers). If the antenna 510 is said to be in front of the board zone 590*a*, then the board lateral surface 593 is the rear surface of the board zone 590*a*.

According to an embodiment, the antenna 510 may be electrically connected to the wireless communication circuit 595. According to an embodiment, the wireless communication circuit 595 may be configured to transmit and/or receive radio signal in a range of about 3 GHz to 100 GHz through the antenna 510. In another embodiment, the wireless communication circuit 595 may be disposed at a position spaced apart from the PCB 590 in the inner space of the electronic device (e.g., the electronic device 300 in FIG. 3A) and be electrically connected to the antenna 510 through an electrical connection member (e.g., an RF coaxial cable or a flexible PCB (FPCB) type RF cable (FRC)).

According to an embodiment, the antenna 510 may be disposed at a position overlapped with a ground layer 5903 extended from the board zone 590*a* of the PCB 590 to the antenna zone 590*b* when the first board surface 591 is viewed from above. According to an embodiment, in the antenna zone 590*b*, the antenna 510 may be disposed at a position farther from the second board surface 592 than the ground layer 5903. According to an embodiment, the antenna 510 may be a monopole antenna that forms a beam pattern in the third direction (denoted by ③) that the board lateral surface 593 of the PCB 590 faces. According to an embodiment, the monopole antenna may emit a signal having a first polarization (e.g., vertical polarization). According to an embodiment, in the antenna zone 590*b* of the PCB 590, the antenna 510 may include a conductive line 511 having a certain length and disposed on one of the insulating layers 5901, a conductive via 512 extended from one end of the conductive line 511 in the first direction (denoted by ①), and/or one or more conductive patterns 513 and 514 branched at right angles from the conductive line 511. According to an embodiment, the conductive line 511 may be extended into the board zone 590*a* and be electrically connected to the wireless communication circuit 595 through an electrical path 5905 (e.g., electrical wiring). According to an embodiment, the conductive patterns 513 and 514 may be disposed on the same insulating layer as the insulating layer on which the conductive line 511 is disposed. In another embodiment, the conductive patterns 513 and 514 may be disposed on an insulating layer different from the insulating layer on which the conductive line 511 is disposed. According to an embodiment, the conductive patterns 513 and 514 may be the first conductive pattern 513 and the second conductive pattern 514, which are extended in directions opposite to each other from the conductive line 511 when the first board surface 591 is viewed from above. According to an embodiment, the first conductive pattern 513 and the second conductive pattern 514 may be spaced apart from each other in the third direction (denoted by ③) and disposed symmetrically with respect to the conductive line 511. According to an embodiment, the antenna 510 may further include a third conductive pattern 515 extended from one end of the conductive via 512 in a direction parallel with the conductive line 511. According to an embodiment, the third conductive pattern 515 may be disposed to be overlapped at least in part with the conductive line 511 when the first board surface 591 is viewed from above. According to an embodiment, depending on the length(s) and/or arrangement position(s) of the first conductive pattern 513, the second conductive pattern 514, and/or the third conductive pattern 515, the radiation characteristics (e.g., operating frequency band, bandwidth, and/or radiation efficiency) of the antenna structure 500 may be determined.

According to an embodiment, the antenna structure 500 may further include a pair of conductive walls 516 and 517 disposed symmetrically with respect to the conductive line 511 interposed therebetween when the first board surface 591 is viewed from above. According to an embodiment, the conductive walls 516 and 517 may be disposed in a direction parallel with the conductive line 511 when the first board surface 591 is viewed from above as shown in FIG. 5C. According to an embodiment, the conductive walls 516 and 517 may be disposed between the conductive line 511 and the third conductive pattern 515 when the board lateral surface 593 is viewed from side as shown in FIG. 5B. According to an embodiment, the conductive walls 516 and 517 may be made of conductive vias, and may be formed with a certain length and/or at certain intervals in the vertical direction (e.g. the first or second direction) in the antenna zone 590*b* of the PCB 590.

According to an embodiment, the antenna structure 500 may be configured to form a beam pattern through the antenna 510 in the third direction (denoted by ③) that the board lateral surface 593 faces. According to an embodiment, the antenna structure 500 may form a beam pattern through the antenna 510 (e.g., a monopole antenna) in a direction (e.g., denoted by ④ in FIG. 9B) tilted at a certain angle from the direction that the board lateral surface 593 faces. Because the antenna structure 500 forms the beam pattern in the direction that the board lateral surface 593 of the PCB 590 faces, the PCB 590 may be disposed in the inner space of the electronic device (e.g., the electronic device 300 in FIG. 3A) to be parallel with the front plate and/or the rear plate of the electronic device. Accordingly, this may be advantageous because it allows for slimming of the electronic device (e.g. minimizing the thickness of the device).

Figure 6:
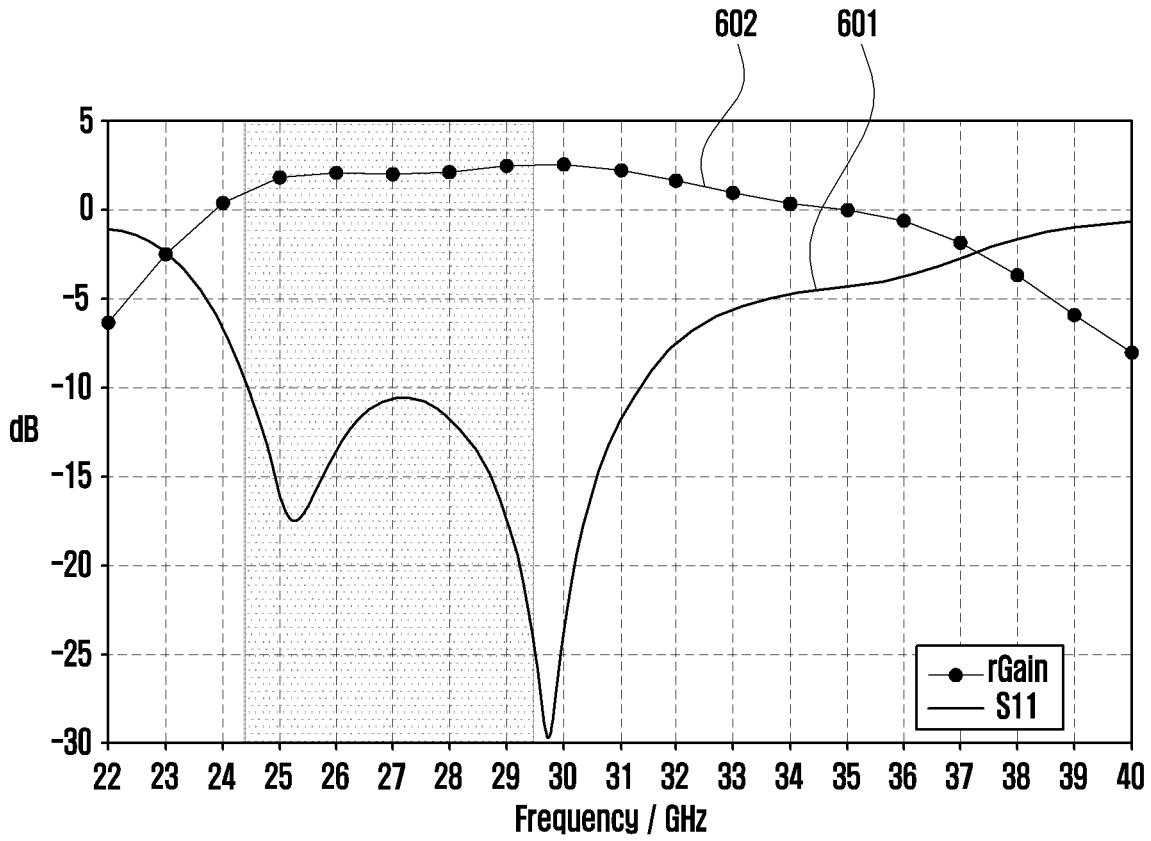
FIG. 6 is a graph showing reflection coefficient (S11) and gain characteristics of the antenna structure shown in FIG. 5A according to an embodiment of the disclosure.

FIG. 6 is a graph showing reflection coefficient (S11) and gain characteristics of the antenna structure shown in FIG. 5A according to an embodiment of the disclosure.

Referring to FIG. 6, the antenna structure (e.g., the antenna structure 500 in FIG. 5A) may be operated to have a bandwidth in the frequency range of about 24.5 GHz to about 29.5 GHz (graph 601). In this case, the antenna structure may be designed as a monopole antenna having a gain of about 3 dBi (graph 602).

FIGS. 7A to 7E are graphs showing frequency characteristics (impedance characteristics) that vary depending on structural changes of an antenna according to certain embodiments of the disclosure.

Figure 7A:
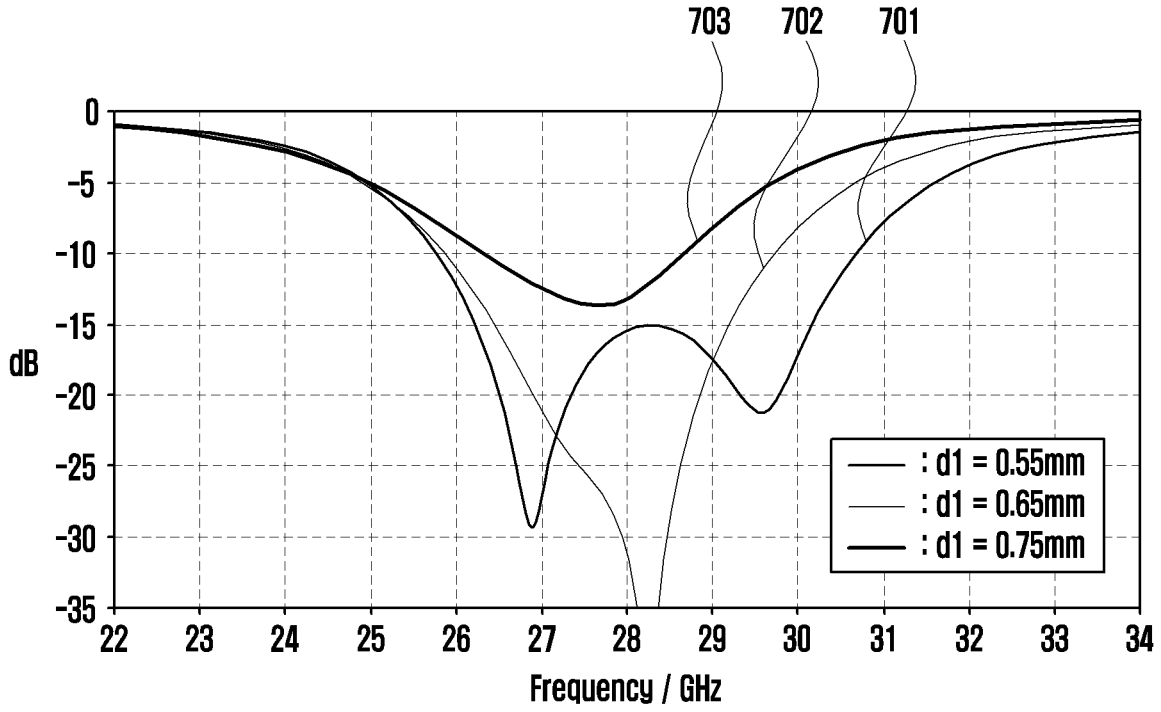
FIGS. 7A to 7E are graphs showing frequency characteristics (impedance characteristics) that vary depending on structural changes of an antenna according to certain embodiments of the disclosure.
Figure 7B:
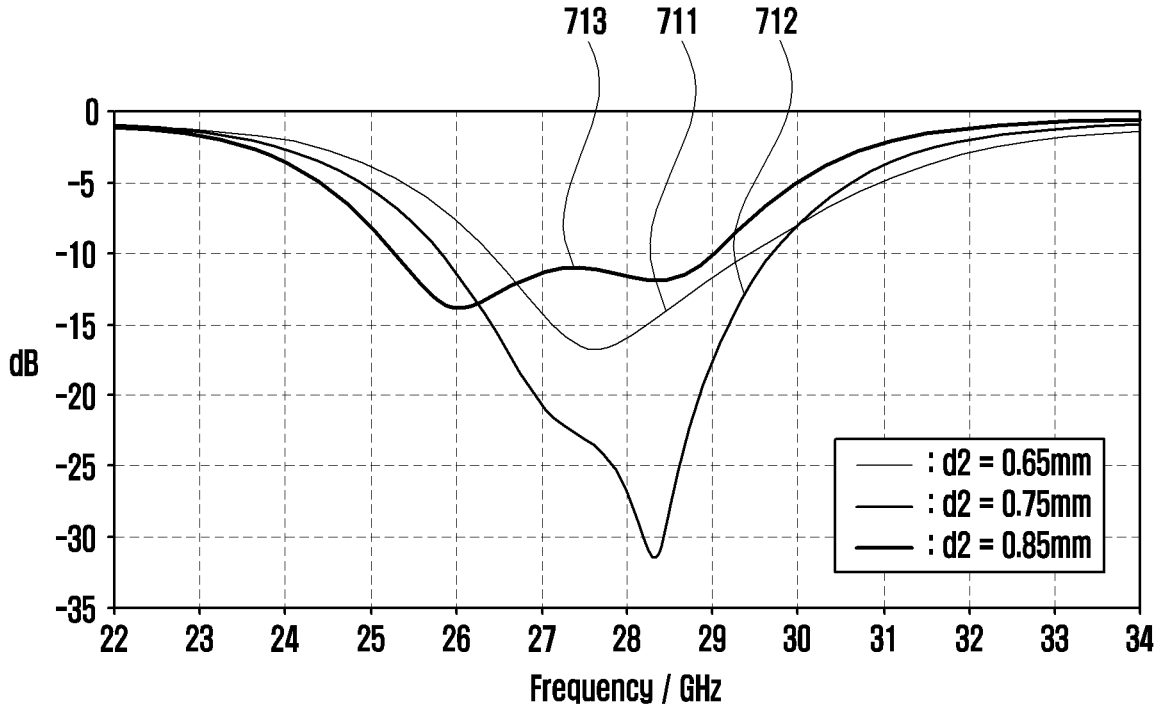

FIGS. 7A and 7B are graphs showing impedance characteristics that change depending on change in the length of at least one conductive pattern (e.g., the conductive patterns 513 and 514 in FIG. 5A) of an antenna (e.g., the antenna 510 in FIG. 5A).

Referring to FIG. 7A, as the length (e.g., the length d1 in FIG. 5C) of the first conductive pattern 513 becomes shorter, as shown by graphs 703, 702, and 701 corresponding to lengths of 0.75 mm, 0.65 mm, and 0.55 mm, respectively, the bandwidth of the antenna 510 increases.

Referring to FIG. 7B, as the length (e.g., the length d2 in FIG. 5C) of the second conductive pattern 514 becomes longer, as shown by graphs 711, 712, and 713 corresponding to lengths of 0.65 mm, 0.75 mm, and 0.85 mm, the bandwidth of the antenna 510 increases.

Figure 7C:
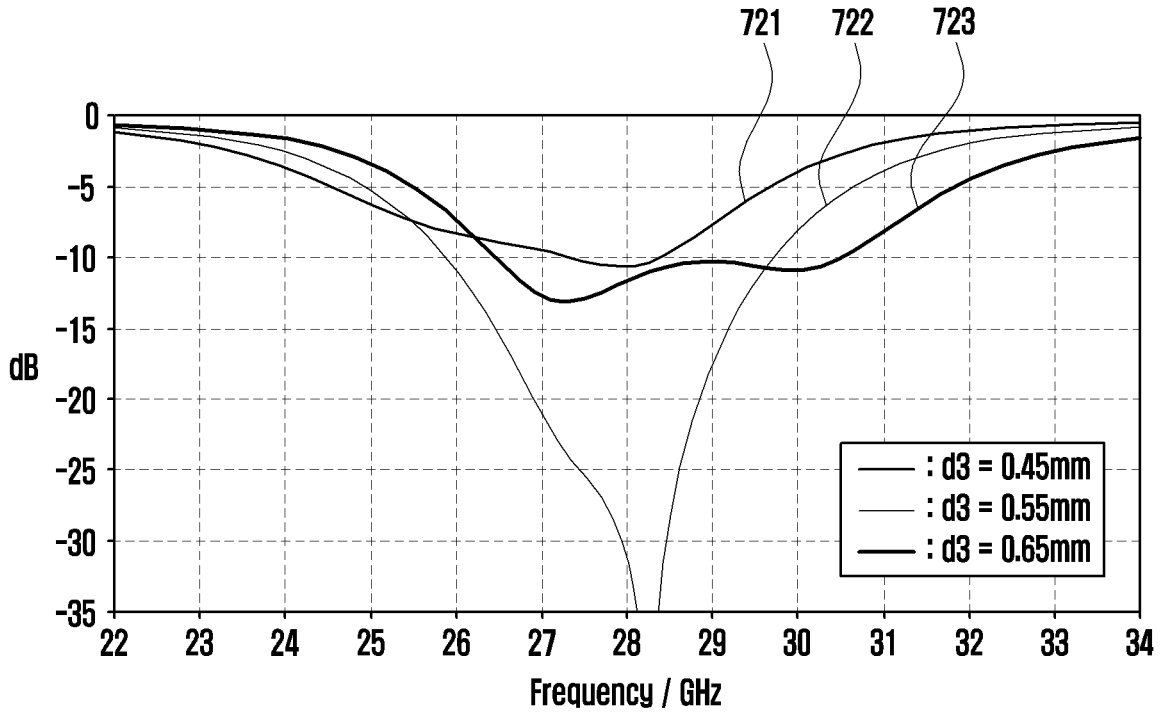
Figure 7D:
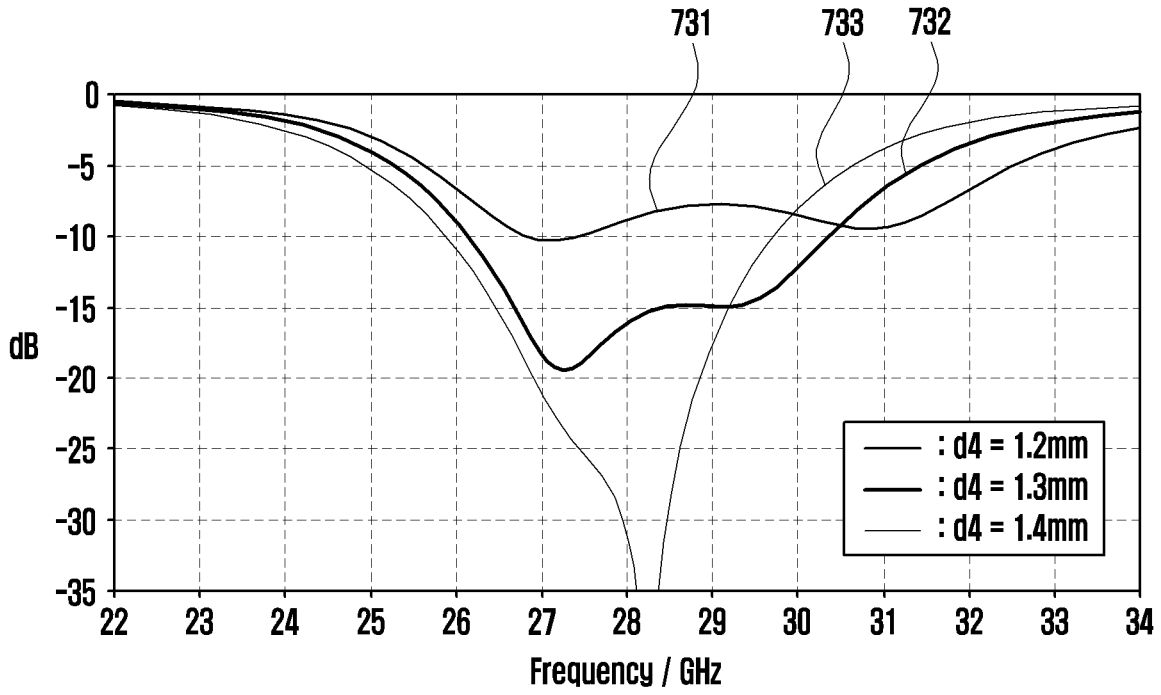

FIGS. 7C and 7D are graphs showing impedance characteristics that change depending on change in the distance from the board zone (e.g., the board zone 590*a* in FIG. 5A) to each of first and second conductive patterns 513 and 514.

Referring to FIG. 7C, when the distance (e.g., the distance d3 in FIG. 5C) from the second conductive pattern 514 to the board zone 590*a* (e.g., a ground layer) increases, as shown by graphs 721, 722, and 723, corresponding to distances of 0.45 mm, 0.55 mm, and 0.65 mm, respectively, the antenna 510 exhibits the best radiation characteristics at 0.55 mm (graph 722).

Referring to FIG. 7D, when the distance (e.g., the distance d4 in FIG. 5C) from the first conductive pattern 513 to the board zone 590*a* increases, as shown by graphs 731, 732, and 733, corresponding to distances of 1.2 mm, 1.3 mm, and 1.4 mm, respectively, the antenna 510 exhibits the best radiation characteristics at 1.4 mm (graph 733).

Figure 7E:
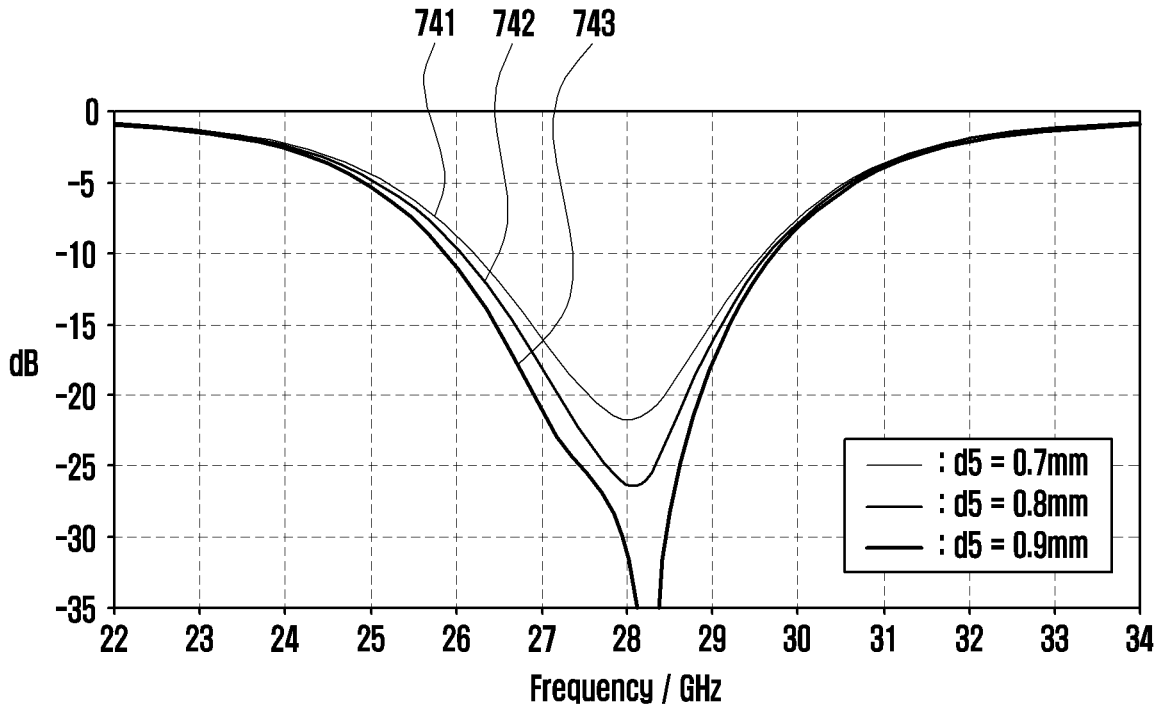

FIG. 7E is a graph showing impedance characteristics that vary depending on change in the length of a conductive wall (e.g., the first conductive wall 516 in FIG. 5C) when the first board surface (e.g., the first board surface 591 in FIG. 5C) is viewed from above.

Referring to FIG. 7E, when the length (e.g., the length d5 in FIG. 5C) of the conductive wall 516 is experimentally varied between 0.7 mm (graph 741), 0.8 mm (graph 742), or 0.9 mm (graph 743), the antenna 510 exhibits the best radiation characteristics at 0.9 mm (graph 743).

As such, in the antenna structure 500 according to exemplary embodiments of the disclosure, the impedance characteristics of the antenna 510 may be determined by adjusting the length (d1, d2) of each conductive pattern 512 or 513, the distance (d3, d4) from the board zone 590*a* to each conductive pattern 512 or 513, and/or the length (d5) of each conductive wall 516 or 517.

Figure 8:
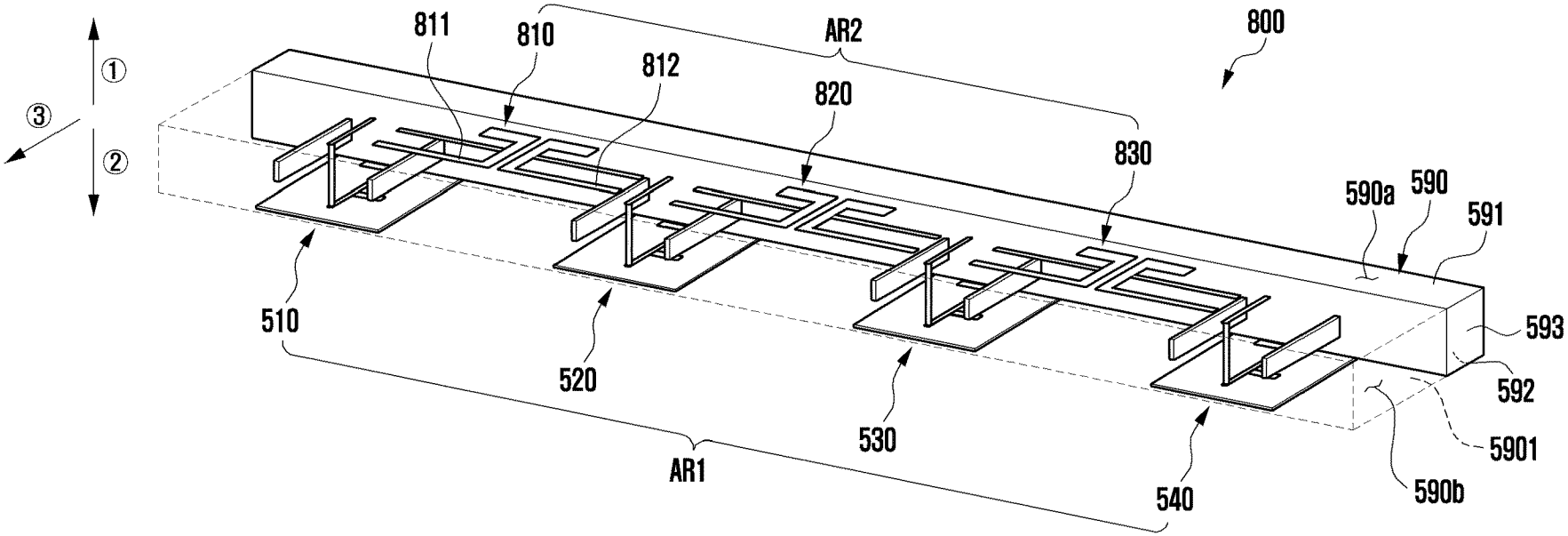
FIG. 8 is a perspective view of an antenna structure according to an embodiment of the disclosure.

FIG. 8 is a perspective view of an antenna structure 800 according to an embodiment of the disclosure.

The antenna structure 800 of FIG. 8 may be similar, at least in part, to the third antenna module 246 of FIG. 2, or may further include other embodiments of the antenna structure.

Referring to FIG. 8, the antenna structure 800 may include a PCB 590, a first antenna array AR1 including a plurality of antennas 510, 520, 530, and 540 (e.g., monopole antennas) disposed at regular intervals in the PCB 590, and a second antenna array AR2 including a plurality of another antennas 810, 820, and 830 (e.g., dipole antennas). According to an embodiment, each of the plurality of antennas 510, 520, 530, and 540 of the first antenna array AR1 may be substantially the same as the antenna 510 of FIG. 5A. According to an embodiment, each of the plurality of antennas 810, 820, and 830 of the second antenna array AR2 may be a dipole antenna composed of a pair of conductive patterns 811 and 812 electrically connected to a wireless communication circuit (e.g., the wireless communication module 192 in FIG. 1 or the wireless communication circuit 595 in FIG. 5B) and a ground layer of the PCB 590.

According to an embodiment, the antenna structure 800 may also include a wireless communication circuit (e.g., the wireless communication module 192 in FIG. 1 or the wireless communication circuit 595 in FIG. 5B) disposed on the second board surface 592 of the PCB 590. In another embodiment, the wireless communication circuit may be disposed at a location spaced apart from the PCB 590. According to an embodiment, the first antenna array AR1 may include a first antenna 510, a second antenna 520, a third antenna 530, and a fourth antenna 540, which are disposed at regular intervals in the antenna zone 590*a* of the PCB 590 and each has substantially the same configuration as the antenna 510 shown in FIG. 5A. According to an embodiment, the second antenna array AR2 may include a fifth antenna 810 disposed between the first antenna 510 and the second antenna 520, a sixth antenna 820 disposed between the second antenna 520 and the third antenna 530, and a seventh antenna 830 disposed between the third antenna 530 and the fourth antenna 540. In other embodiments, each of the first antenna array AR1 and the second antenna array AR2 may include two, three, four, five, or more antennas arranged in the same manner as described above.

According to an embodiment, the wireless communication circuit may be configured to transmit and/or receive a first signal having a first polarization (e.g., vertical polarization) through the first antenna array AR1. According to an embodiment, the wireless communication circuit may be configured to transmit and/or receive a second signal having a second polarization (e.g., horizontal polarization) through the second antenna array AR2. According to an embodiment, the antenna structure 800 may be configured to form a beam pattern through the first and second antenna arrays AR1 and AR2 in a direction (denoted by ③) that the board lateral surface 593 of the PCB 590 faces. According to an embodiment, the wireless communication circuit may transmit and/or receive the first and second signals, identical to or different from each other, in the same frequency band.

Figure 9A:
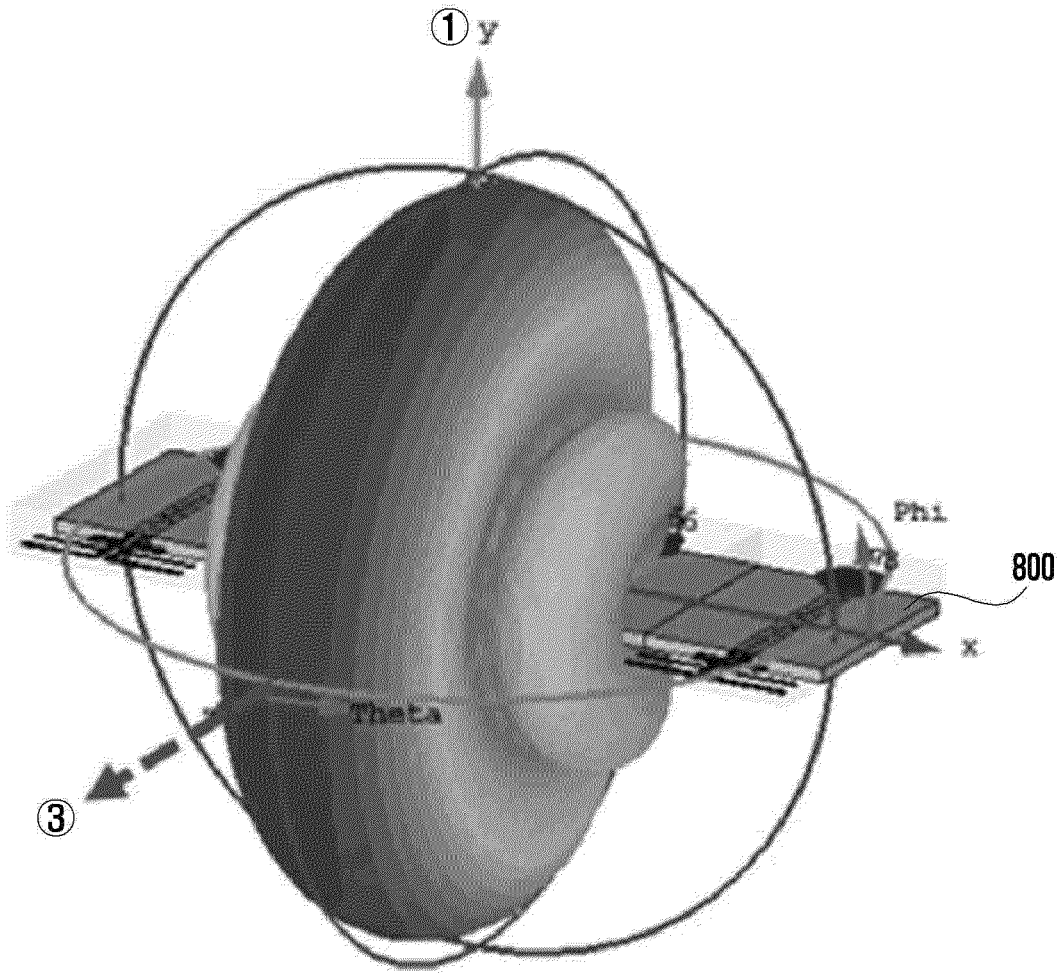
FIGS. 9A and 9B are diagrams illustrating radiation characteristics of the antenna structure of FIG. 8 according to an embodiment of the disclosure.
Figure 9B:
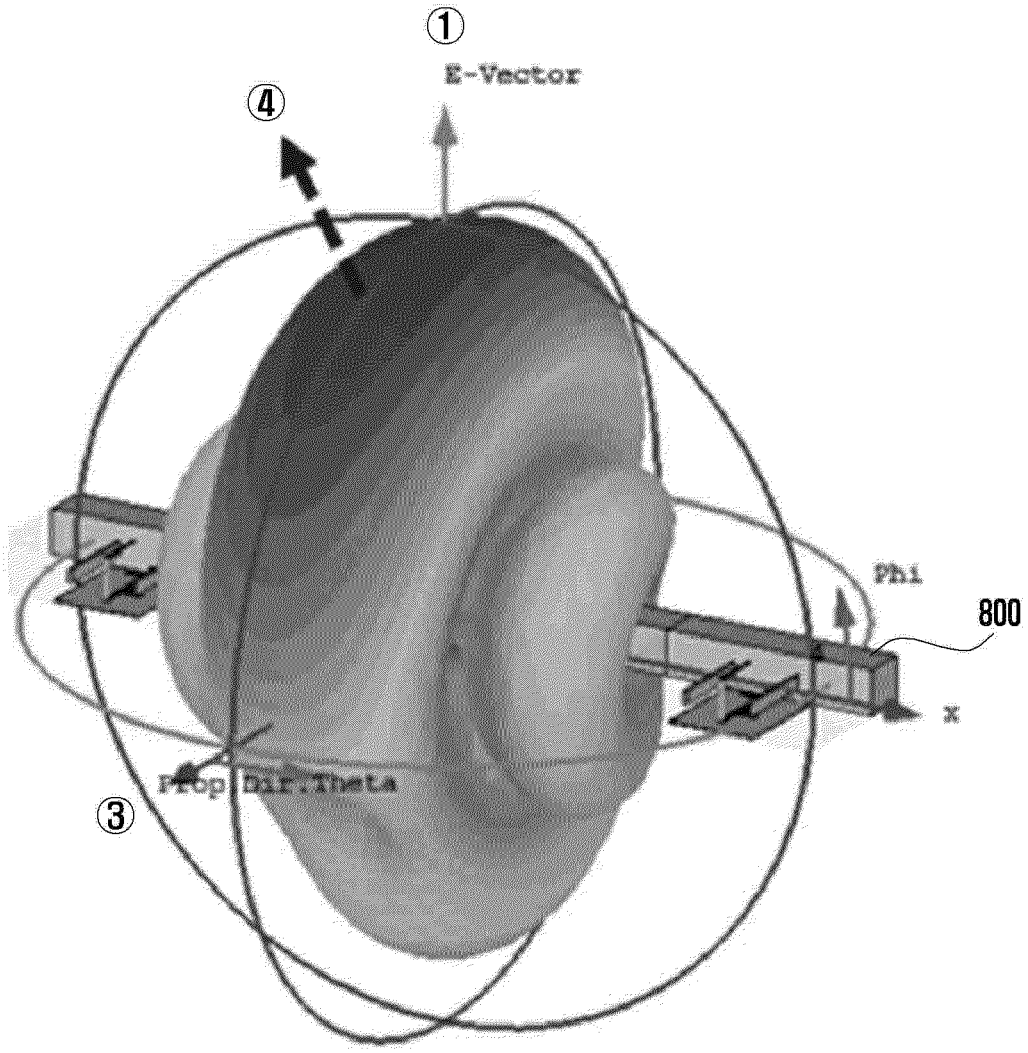
Figure 10:
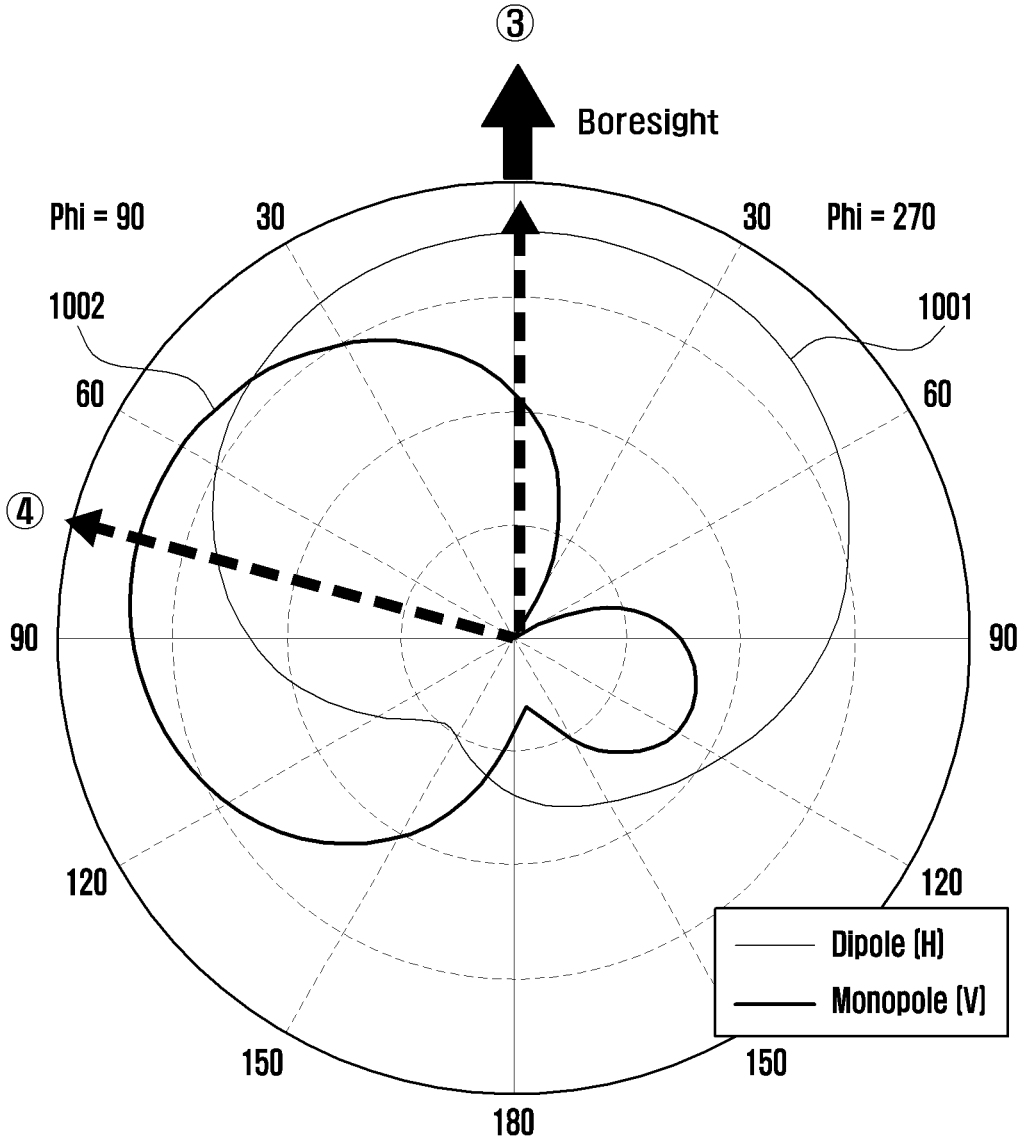
FIG. 10 is a diagram illustrating a radiation pattern of the antenna structure of FIG. 8 according to an embodiment of the disclosure.

FIGS. 9A and 9B are diagrams illustrating radiation characteristics of the antenna structure 800 of FIG. 8 according to an embodiment of the disclosure. FIG. 10 is a diagram illustrating a radiation pattern of the antenna structure 800 of FIG. 8 according to an embodiment of the disclosure.

Referring to FIG. 9A, the second antenna array AR2 including the plurality of dipole antennas 810, 820, and 830 may form a beam pattern (i.e., a radiation pattern 1001 in FIG. 10) in a boresight direction (denoted by ③) that the board lateral surface 593 of the PCB 590 faces.

Referring to FIG. 9B, the first antenna array AR1 including the plurality of monopole antennas 510, 520, 530, and 540 may form a beam pattern (i.e., a radiation pattern 1002 in FIG. 10) in a certain tilted direction (denoted by ④) between the direction that the board lateral surface 593 faces and the direction that the first board surface 591 faces.

According to an embodiment, because the first antenna array AR1 and the second antenna array AR2, which form beam patterns in different directions, are disposed together in the PCB 590, the antenna structure 800 may be disposed in the electronic device to form beam patterns in various directions (e.g., toward the front, rear, and/or lateral surfaces).

Figure 11A:
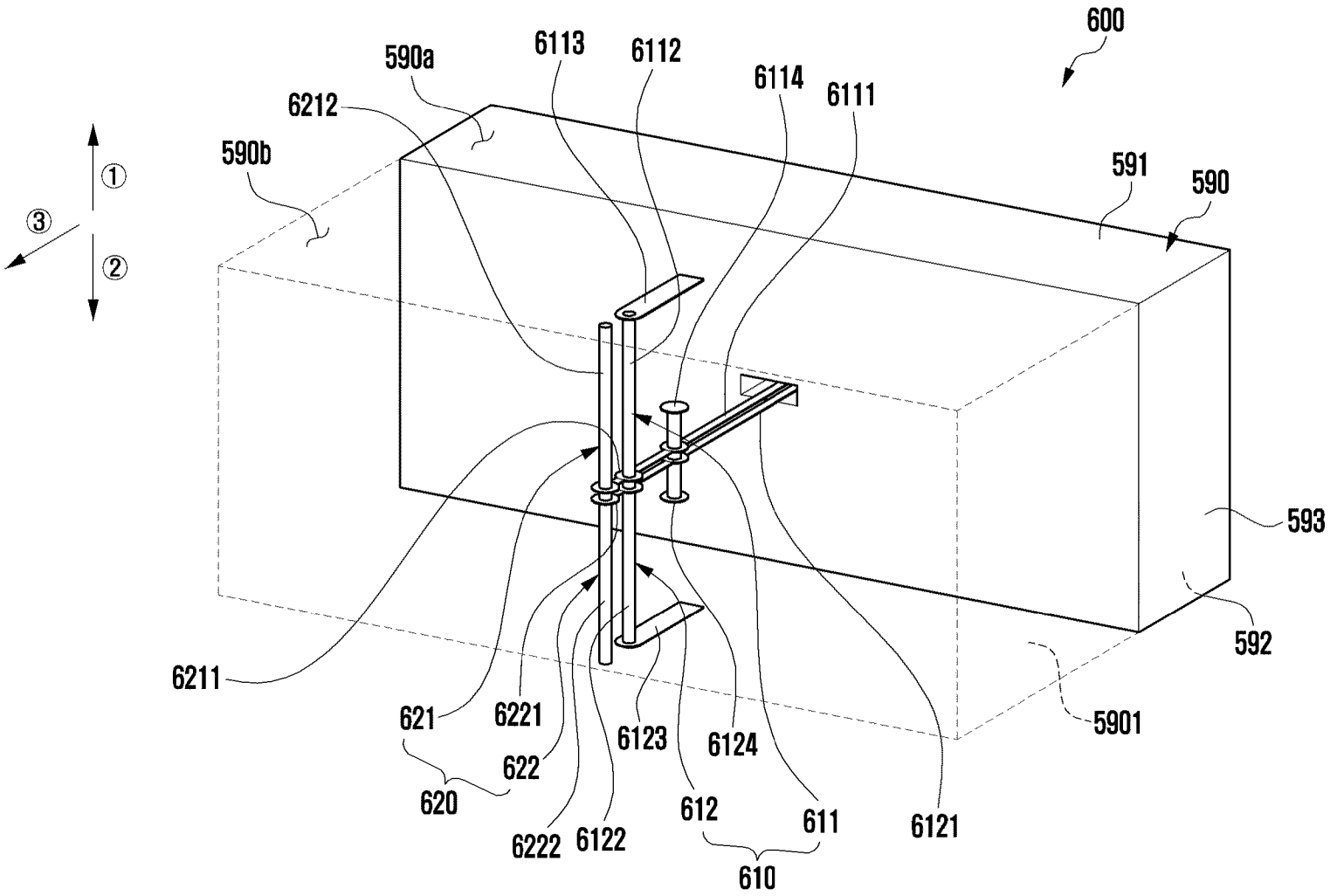
FIG. 11A is a perspective view illustrating an antenna structure according to an embodiment of the disclosure.
Figure 11B:
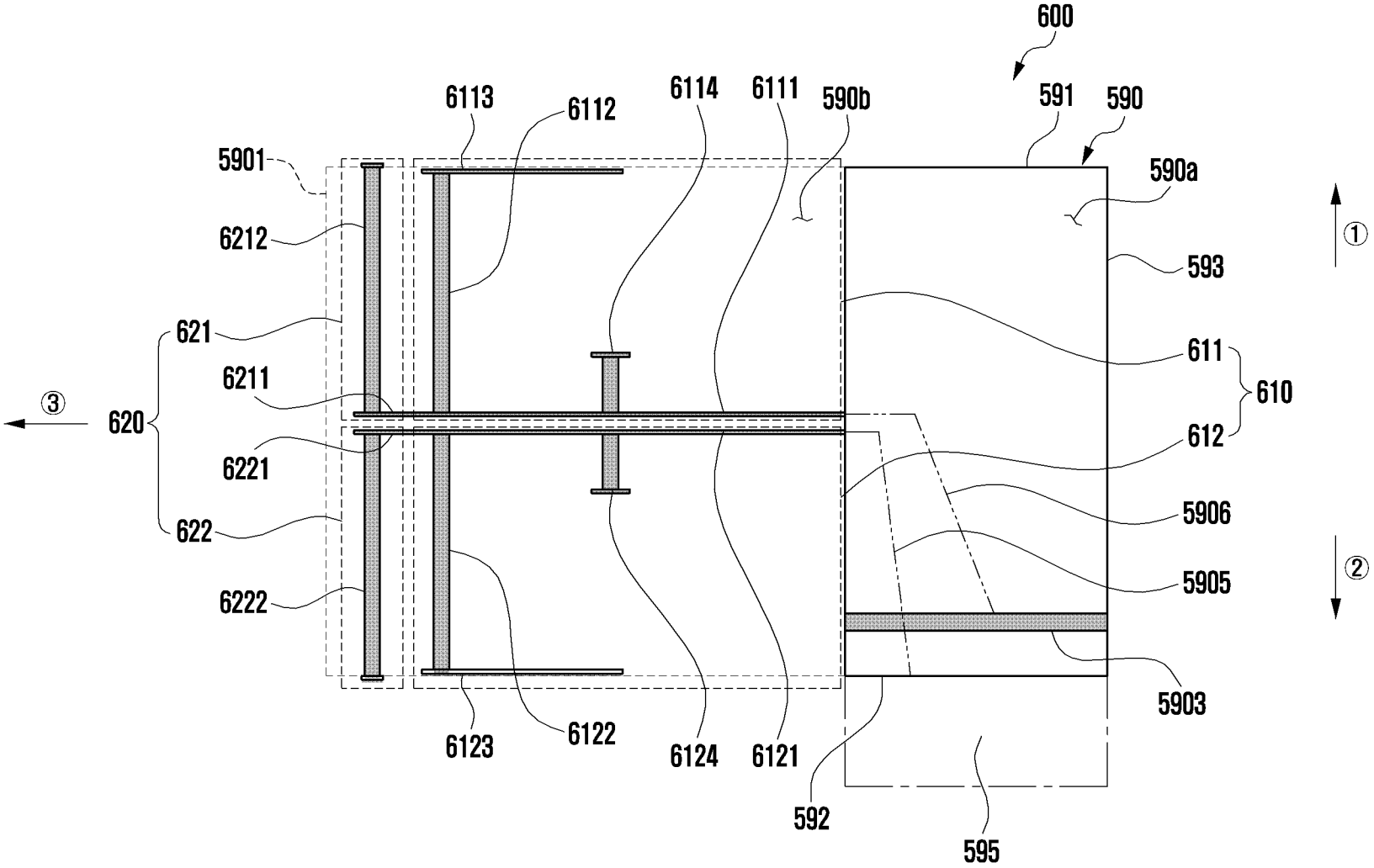
FIG. 11B is a side view illustrating the antenna structure of FIG. 11A according to an embodiment of the disclosure.
Figure 11C:
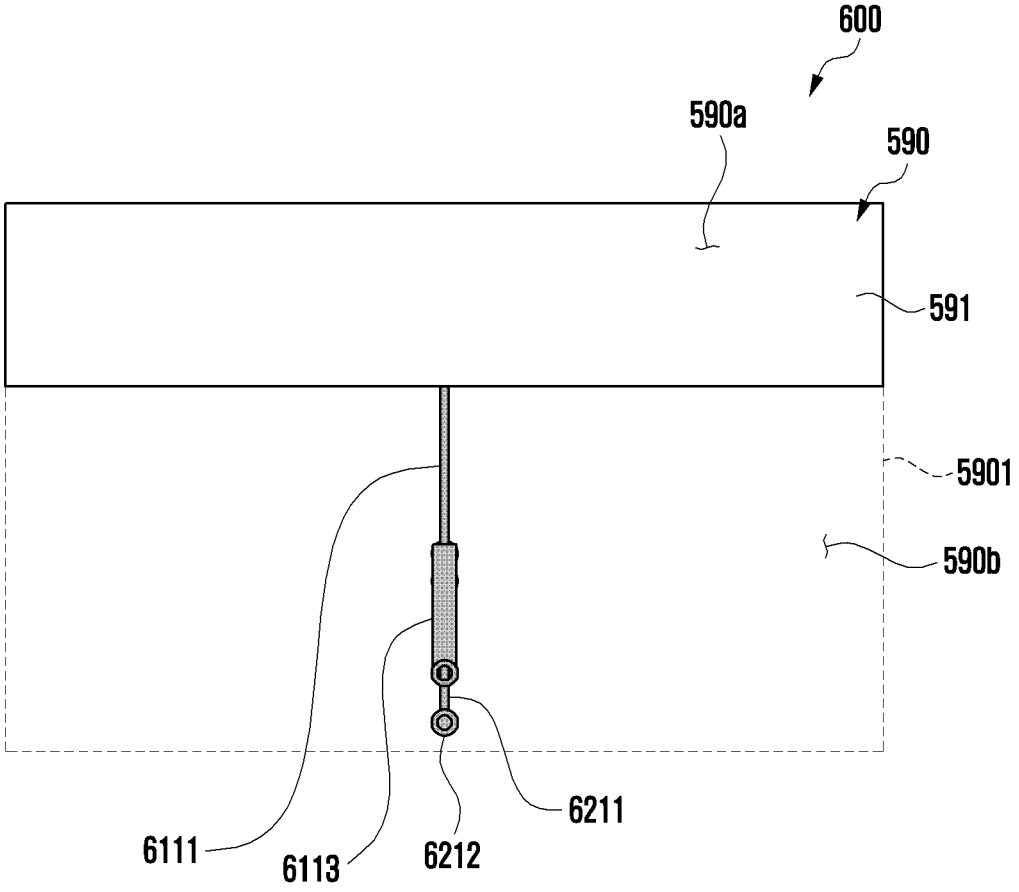
FIG. 11C is a plan view illustrating the antenna structure of FIG. 11A according to an embodiment of the disclosure.
Figure 11D:
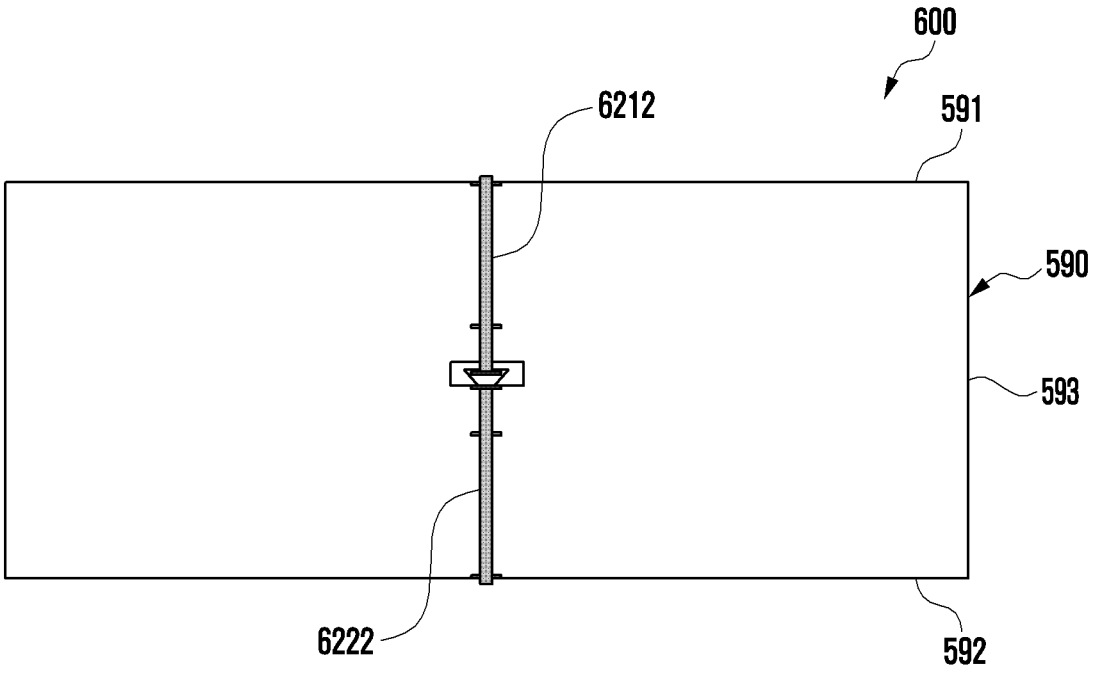
FIG. 11D is a front view illustrating the antenna structure of FIG. 11A according to an embodiment of the disclosure.

FIG. 11A is a perspective view illustrating an antenna structure 600 according to an embodiment of the disclosure. FIG. 11B is a side view illustrating the antenna structure 600 of FIG. 11A according to an embodiment of the disclosure. FIG. 11C is a plan view illustrating the antenna structure 600 of FIG. 11A according to an embodiment of the disclosure. FIG. 11D is a front view illustrating the antenna structure 600 of FIG. 11A according to an embodiment of the disclosure.

The antenna structure 600 shown in FIGS. 11A to 11D may be similar, at least in part, to the third antenna module 246 of FIG. 2, or may include other embodiments of the antenna structure.

Referring to FIGS. 11A to 11D, the antenna structure 600 may include a PCB 590 and a first antenna 610 disposed in the PCB 590. According to an embodiment, the PCB 590 and the wireless communication circuit 595 mounted on or spaced apart from the PCB 590 have substantially the same configurations as those of the PCB 590 and the wireless communication circuit 595 of FIGS. 5A and 5B, respectively, so that a detailed description thereof will be omitted.

According to an embodiment, the first antenna 610 may include a first antenna element 611 and a second antenna element 612, which are disposed symmetrically to each other in a vertical direction of the PCB 590 (e.g., the direction from the first board surface 591 to the second board surface 592). According to an embodiment, the wireless communication circuit 595 may be configured to transmit and/or receive a radio signal of a first frequency band (e.g., a band in the range of about 24 GHz to about 30 GHz) (e.g., a band of about 28 GHz) through the first antenna 610.

According to an embodiment, the first antenna element 611 may include, in the antenna zone 590*a*, a first conductive line 6111 having a certain length and disposed on one of the insulating layers 5901, a first conductive via 6112 extended from one end of the first conductive line 6111 in the first direction (denoted by ①), and/or a first conductive pattern 6113 extended from the first conductive via 6112. According to an embodiment, the first conductive pattern 6113 may be disposed to be overlapped, at least in part, with the first conductive line 6111 when the first board surface 591 is viewed from above. According to an embodiment, the first antenna element 611 may further include at least one first conductive stub 6114 having a certain length and extended from the first conductive line 6111 in the first direction.

According to an embodiment, the second antenna element 612 may include, in the antenna zone 590*a*, a second conductive line 6121 having a certain length and disposed on one of the insulating layers 5901, a second conductive via 6122 extended from one end of the second conductive line 6121 in the second direction (denoted by ②), and/or a second conductive pattern 6123 extended from the second conductive via 6122. According to an embodiment, the second conductive line 6121 may be disposed on an insulating layer different from the insulating layer on which the first conductive line 6111 is disposed. According to an embodiment, the second conductive pattern 6123 may be disposed to be overlapped, at least in part, with the second conductive line 6121 when the first board surface 591 is viewed from above. According to an embodiment, the second antenna element 612 may further include at least one second conductive stub 6124 having a certain length and extended from the second conductive line 6121 in the second direction. According to an embodiment, the second conductive line 6121 may be disposed near the first conductive line 6111 to be overlapped with the first conductive line 6111 when the first board surface 591 is viewed from above. According to an embodiment, the second conductive line 6121 may have substantially the same length and shape as the first conductive line 6111. According to an embodiment, the second conductive via 6122 may be disposed to be overlapped with the first conductive via 6112 when the first board surface 591 is viewed from above. According to an embodiment, the second conductive via 6122 may have substantially the same length as that of the first conductive via 6112. According to an embodiment, the second conductive pattern 6123 may have substantially the same length as that of the first conductive pattern 6113. For example, when the first board surface 591 is viewed from above, all of the first conductive line 6111, the second conductive line 6121, the first conductive pattern 6113, and the second conductive pattern 6123 may be overlapped with each other at least in part. According to an embodiment, the first conductive line 6111 may be extended to the board zone 590*a* and electrically connected to the ground layer 5903 of the PCB 590 through a first electrical path 5906 (e.g., electrical wiring). In addition, the second conductive line 6121 may be extended to the board zone 590*a* and electrically connected to the wireless communication circuit 595 through a second electrical path 5905 (e.g., electrical wiring). In another embodiment, the first conductive line 6111 may be electrically connected to the wireless communication circuit 595, and the second conductive line 6121 may be electrically connected to the ground layer 5903. In still another embodiment, both the first conductive line 6111 and the second conductive line 6121 may be electrically connected to the wireless communication circuit 595. In this case, the first conductive line 6111 and the second conductive line 6121 may be electrically connected to the wireless communication circuit 595 so as to have opposite phases to each other. Thus, the first antenna 610 may operate as a vertically polarized dipole antenna that forms a beam pattern in the third direction (denoted by ③) that the board lateral surface 593 of the PCB 590 faces.

According to an embodiment, the antenna structure 600 may further include a second antenna 620. According to an embodiment, the second antenna 620 may include a third antenna element 621 and a fourth antenna element 622. According to an embodiment, the wireless communication circuit 595 may be configured to transmit and/or receive, through the second antenna 620, a radio signal of a second frequency band (e.g., a band in the range of about 36 GHz to about 42 GHz) (e.g., a band of about 39 GHz) higher than the first frequency band.

According to an embodiment, the third antenna element 621 may include a first conductive extension pattern 6211 extended from the first conductive line 6111, and a third conductive via 6212 having a certain length and extended from the first conductive extended pattern 6211 in the first direction (denoted by ①). For example, the first conductive extension pattern 6211 and the first conductive line 6111 may be disposed on the same insulating layer. According to an embodiment, the fourth antenna element 622 may include a second conductive extension pattern 6221 extended from the second conductive line 6121, and a fourth conductive via 6222 having a certain length and extended from the second conductive extension pattern 6221 in the second direction (denoted by ②). For example, the second conductive extension pattern 6221 and the second conductive line 6121 may be disposed on the same insulating layer. According to an embodiment, the first conductive extension pattern 6211 may be disposed to be overlapped with the second conductive extension pattern 6221 when the first board surface 591 is viewed from above. According to an embodiment, the third conductive via 6212 may be disposed to be overlapped with the fourth conductive via 6222 when the first board surface 591 is viewed from above.

According to an embodiment, impedance characteristics of the first antenna 610 and/or the second antenna 620 may be determined by adjusting the number of the first conductive stubs 6114 or the second conductive stubs 6124, the length of each of the first and second conductive stubs 6114 and 6124, and/or the length of each the first and second conductive patterns 6113 and 6123.

Figure 12A:
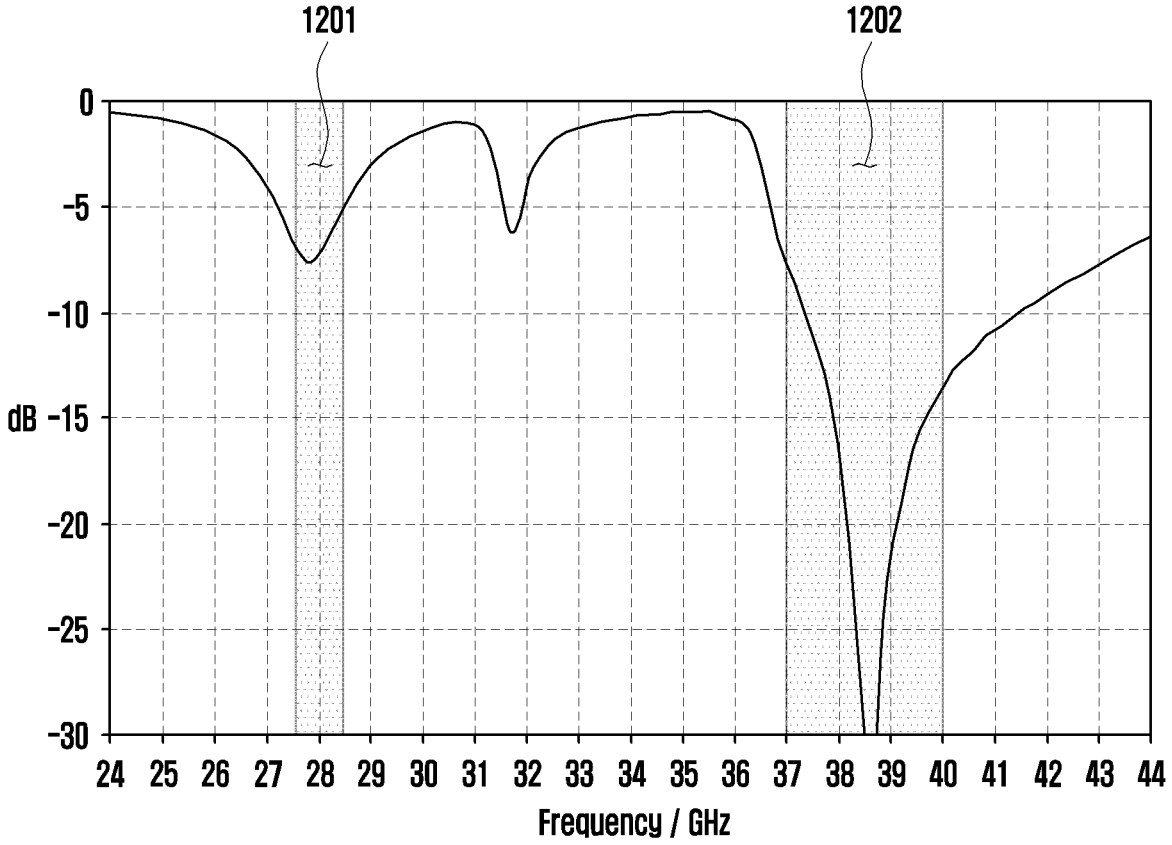
FIG. 12A is a graph showing the reflection coefficient of the antenna structure of FIG. 11A according to an embodiment of the disclosure.

FIG. 12A is a graph showing the reflection coefficient of the antenna structure 600 of FIG. 11A according to an embodiment of the disclosure. Referring to FIG. 12A, the antenna structure 600 may operate in the first frequency band (e.g., about 39 GHz) having a bandwidth 1202 of about 3 GHz and in the second frequency band (e.g., about 28 GHz) having a bandwidth 1201 of about 1 GHz.

Figure 12B:
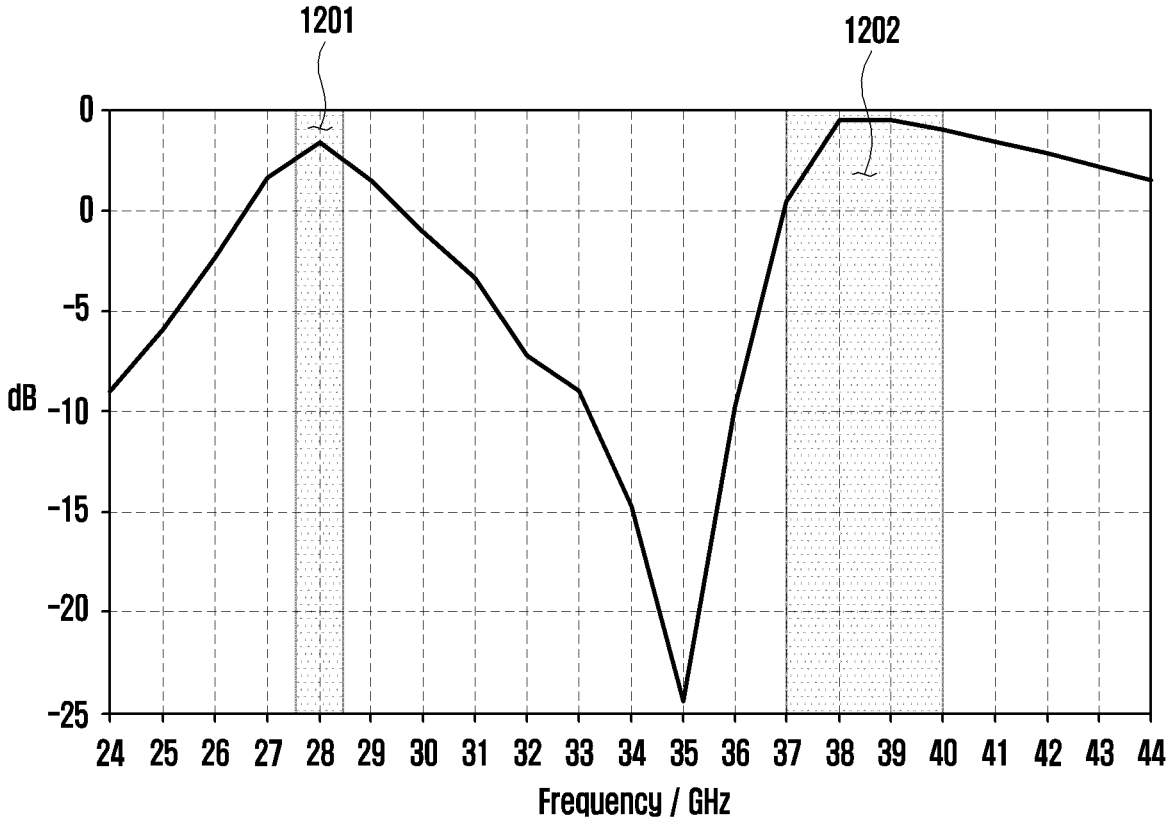
FIG. 12B is a graph showing gain characteristics of the antenna structure of FIG. 11A according to an embodiment of the disclosure.

FIG. 12B is a graph showing gain characteristics of the antenna structure 600 of FIG. 11A according to an embodiment of the disclosure. Referring to FIG. 12B, the antenna structure 600 may operate as an antenna that exhibits a gain of about 4 dBi in the first frequency band (e.g., about 39 GHz) and a gain of about 3 dBi in the second frequency band (e.g., about 28 GHz).

Figure 13:
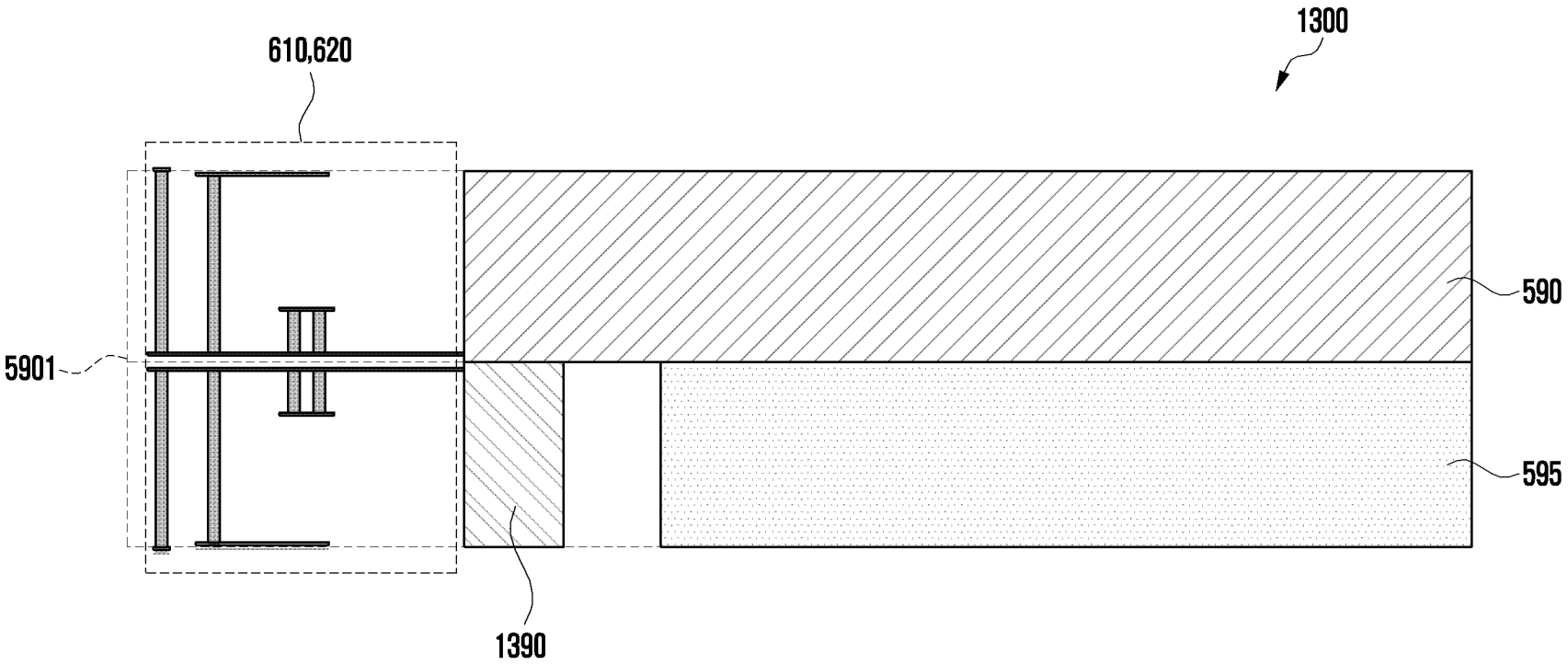
FIG. 13 is a diagram illustrating an antenna structure according to an embodiment of the disclosure.

FIG. 13 is a diagram illustrating an antenna structure 1300 according to an embodiment of the disclosure.

The antenna structure 1300 of FIG. 13 may be similar, at least in part, to the third antenna module 246 of FIG. 2, or may further include other embodiments of the antenna structure.

Referring to FIG. 13, the antenna structure 1300 may include a first PCB 590, a second PCB 1390 stacked under the first PCB 590, and first and second antennas 610 and 620 formed in insulating layers extended from the first and second PCBs 590 and 1390. According to an embodiment, the first antenna 610 and the second antenna 620 may have substantially the same configuration as the first antenna 610 and the second antenna 620 of FIG. 5A, respectively. According to an embodiment, the stack of the first and second PCBs 590 and 1390 increases the entire thickness of the PCB, so that the antenna structure 1300 may have improved broadband characteristics.

Figure 14:
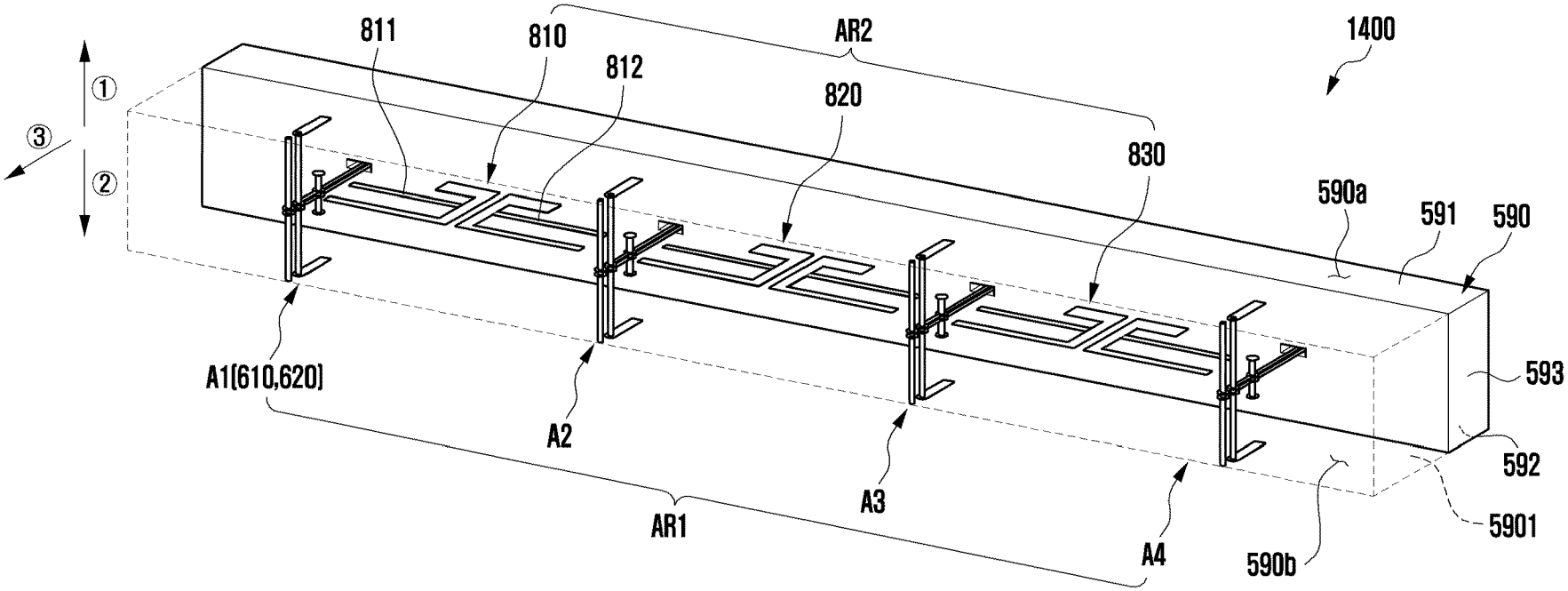
FIG. 14 is a perspective view of an antenna structure according to an embodiment of the disclosure.

FIG. 14 is a perspective view of an antenna structure 1400 according to an embodiment of the disclosure.

The antenna structure 1400 of FIG. 14 may be similar, at least in part, to the third antenna module 246 of FIG. 2, or may further include other embodiments of the antenna structure.

Referring to FIG. 14, the antenna structure 1400 may include a PCB 590, a first antenna array AR1 including a plurality of antennas A1, A2, A3, and A4 (e.g., dipole antennas) disposed at regular intervals in the PCB 590, and a second antenna array AR2 including a plurality of other antennas 810, 820, and 830 (e.g., dipole antennas). According to an embodiment, each of the plurality of antennas A1, A2, A3, and A4 of the first antenna array AR1 may be composed of the first and second antennas 610 and 620 shown in FIG. 11A. According to an embodiment, each of the plurality of antennas 810, 820, and 830 of the second antenna array AR2 may be a dipole antenna composed of a pair of conductive patterns 811 and 812 electrically connected to a wireless communication circuit (e.g., the wireless communication module 192 in FIG. 1 or the wireless communication circuit 595 in FIG. 5B) and a ground layer (e.g., the ground layer 5903 in FIG. 11B) of the PCB 590.

According to an embodiment, the antenna structure 1400 may also include a wireless communication circuit (e.g., the wireless communication module 192 in FIG. 1 or the wireless communication circuit 595 in FIG. 5B) disposed on the second board surface 592 of the PCB 590. In another embodiment, the wireless communication circuit may be disposed at a location spaced apart from the PCB 590. According to an embodiment, the first antenna array AR1 may include a first antenna A1, a second antenna A2, a third antenna A3, and a fourth antenna A4, which are disposed at regular intervals in the antenna zone 590*a* of the PCB 590 and each is substantially composed of the first and second antennas 610 and 620 shown in FIG. 11A. According to an embodiment, the second antenna array AR2 may include a fifth antenna 810 disposed between the first antenna A1 and the second antenna A2, a sixth antenna 820 disposed between the second antenna A2 and the third antenna A3, and a seventh antenna 830 disposed between the third antenna A3 and the fourth antenna A4. In other embodiments, each of the first antenna array AR1 and the second antenna array AR2 may include two, three, four, five, or more antennas arranged in the same manner as described above.

According to an embodiment, the wireless communication circuit may be configured to transmit and/or receive a first signal having a first polarization (e.g., vertical polarization) through the first antenna array AR1. According to an embodiment, the wireless communication circuit may be configured to transmit and/or receive a second signal having a second polarization (e.g., horizontal polarization) through the second antenna array AR2. According to an embodiment, the antenna structure 1400 may be configured to form a beam pattern through the first and second antenna arrays AR1 and AR2 in a direction (denoted by ③) that the board lateral surface 593 of the PCB 590 faces. According to an embodiment, the wireless communication circuit may transmit and/or receive the first and second signals, identical to or different from each other, in the same frequency band.

Figure 15A:
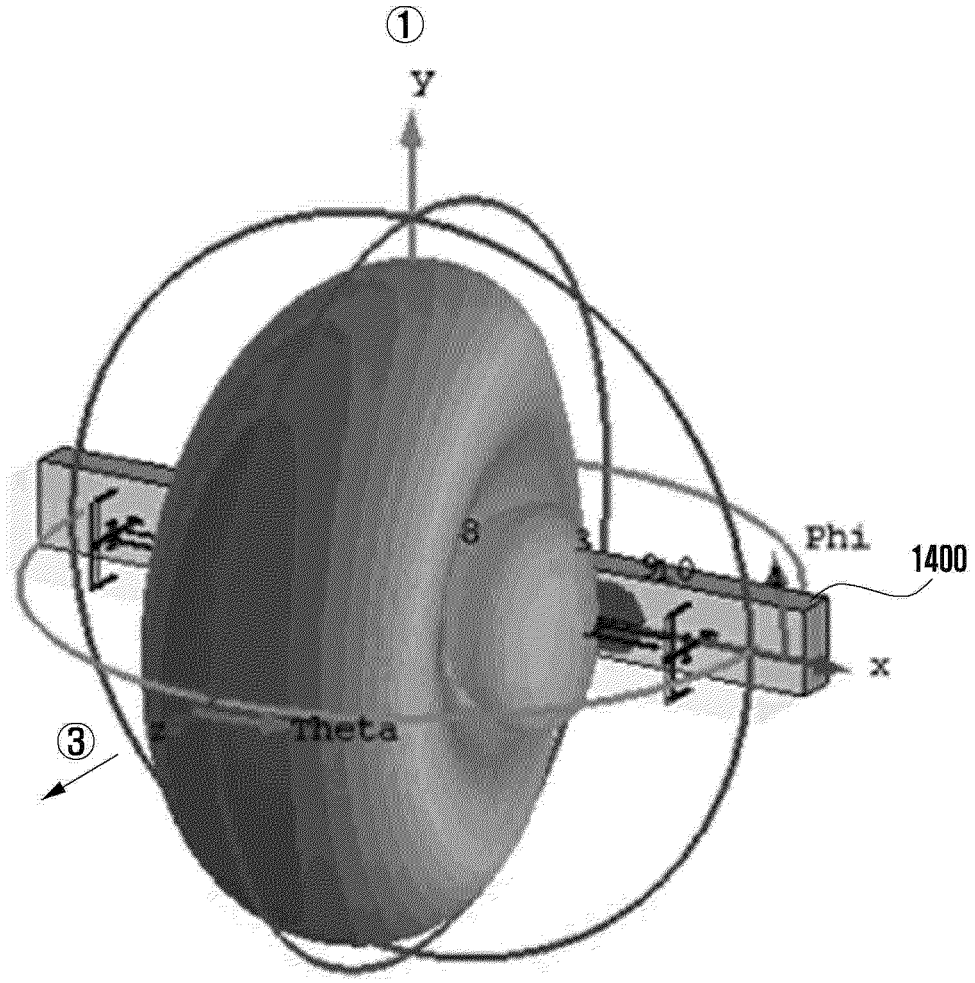
FIGS. 15A and 15B are diagrams illustrating radiation characteristics of the antenna structure of FIG. 14 according to an embodiment of the disclosure.
Figure 15B:
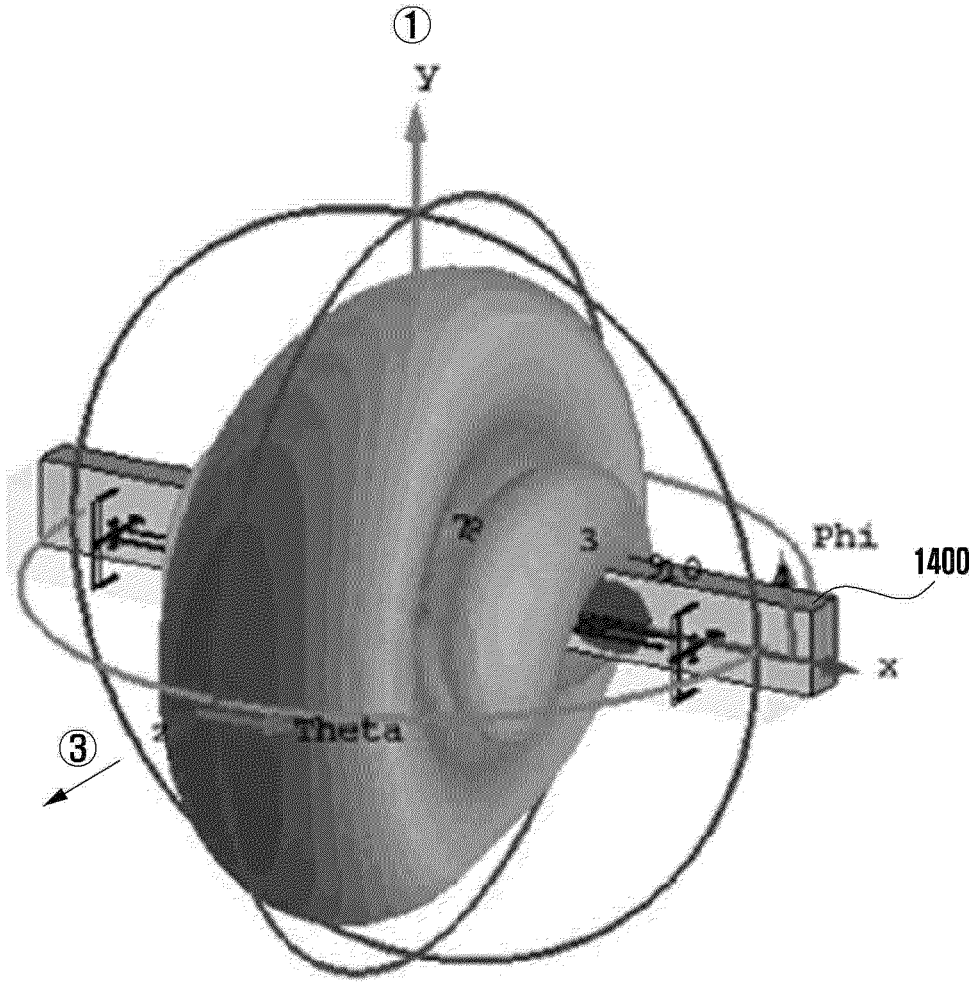
Figure 16:
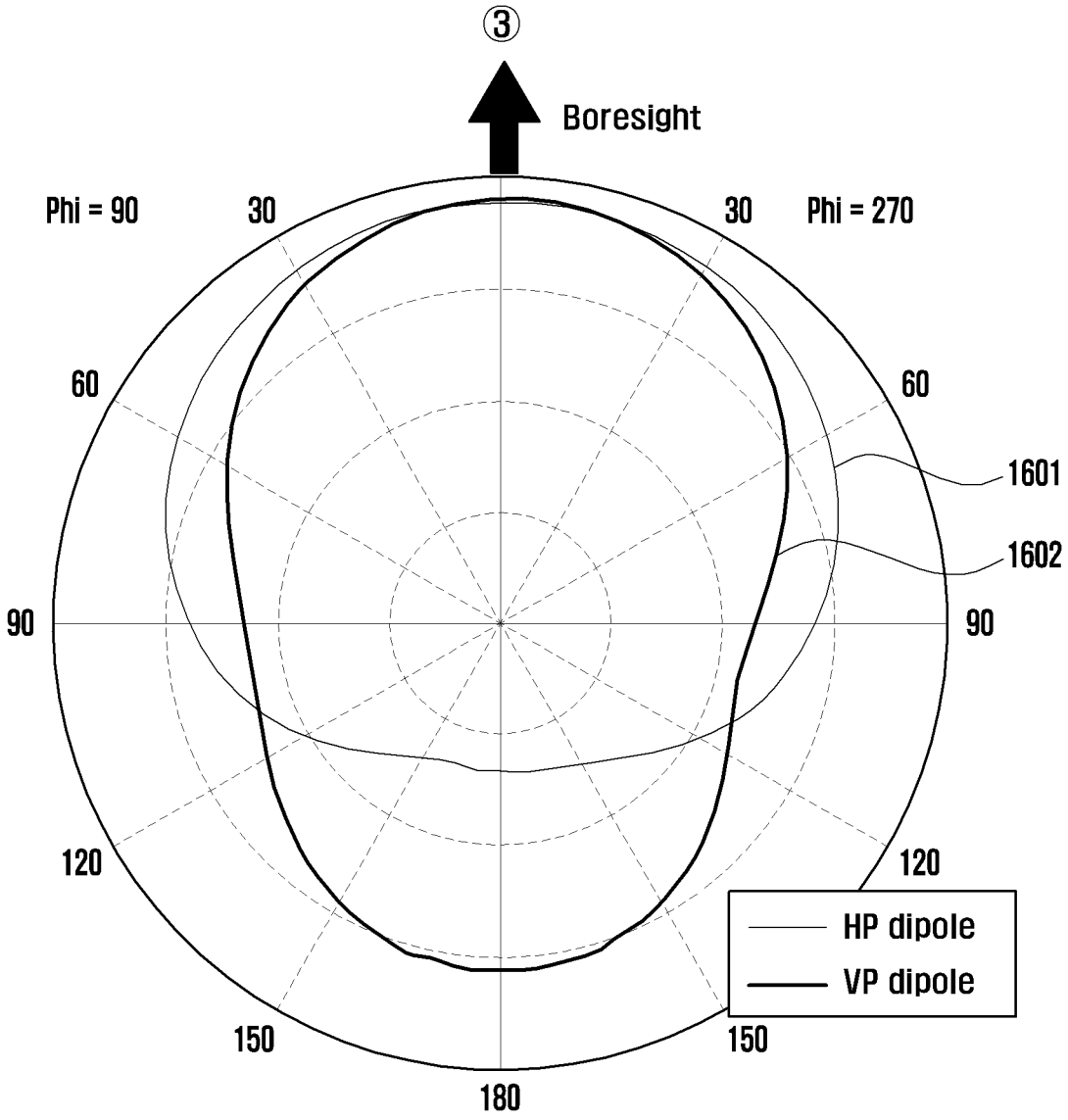
FIG. 16 is a diagram illustrating a radiation pattern of the antenna structure of FIG. 14 according to an embodiment of the disclosure.

FIGS. 15A and 15B are diagrams illustrating radiation characteristics of the antenna structure 1400 of FIG. 14 according to an embodiment of the disclosure. FIG. 16 is a diagram illustrating a radiation pattern of the antenna structure 1400 of FIG. 14 according to an embodiment of the disclosure.

Referring to FIG. 15A, the second antenna array AR2 including the plurality of dipole antennas 810, 820, and 830 may form a beam pattern (i.e., a radiation pattern 1601 in FIG. 16) in a boresight direction (denoted by ③) that the board lateral surface 593 of the PCB 590 faces.

Referring to FIG. 15B, the first antenna array AR1 including the plurality of dipole antennas A1, A2, A3, and A4 may also form a beam pattern (i.e., a radiation pattern 1602 in FIG. 16) in a boresight direction (denoted by ③) that the board lateral surface 593 of the PCB 590 faces.

Figure 17A:
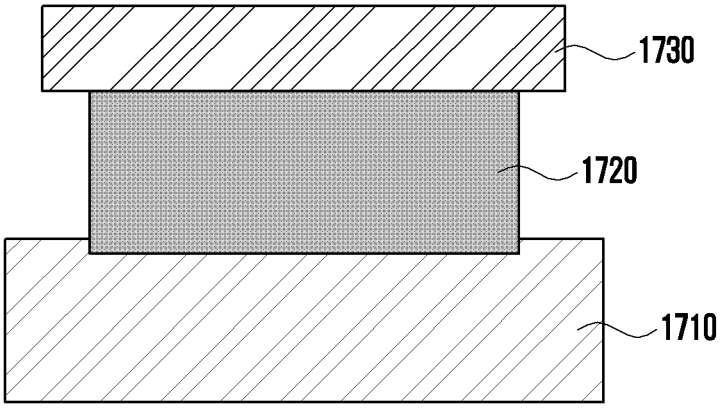
FIGS. 17A to 17C are diagrams illustrating a connection structure between a wireless communication circuit and an antenna structure according to certain embodiments of the disclosure.
Figure 17B:
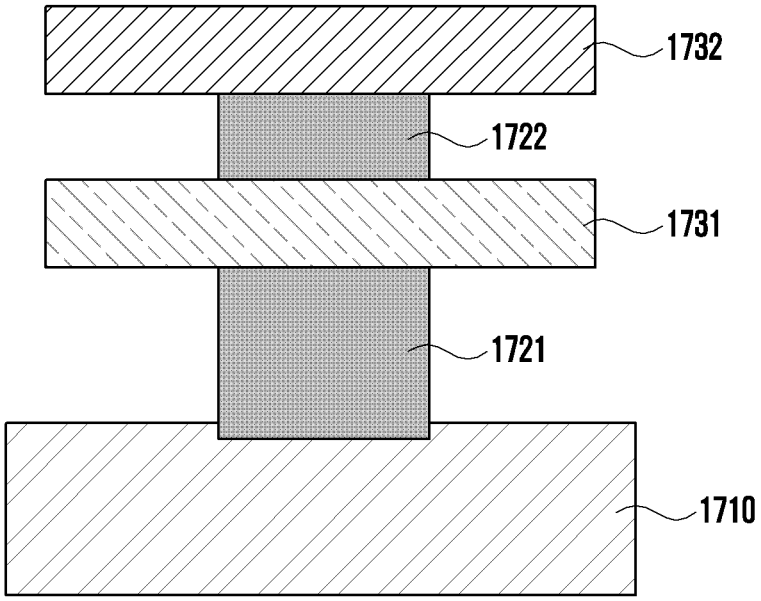
Figure 17C:
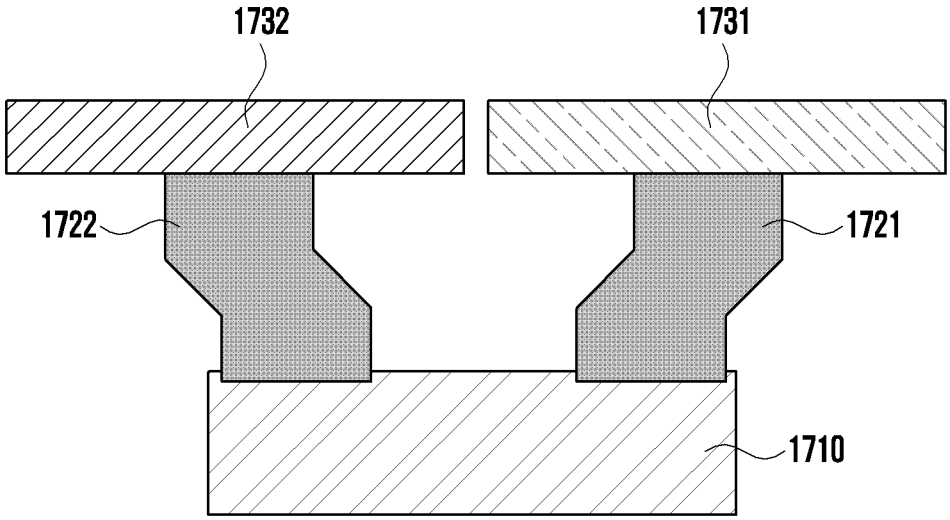

FIGS. 17A to 17C are diagrams illustrating a connection structure between a wireless communication circuit 1710 and an antenna structure 1730, 1731, or 1732 according to certain embodiments of the disclosure.

According to various different embodiments, depending on the configuration of the antenna disposed on a PCB (e.g., the PCB 590 in FIG. 5A), the antenna structure may be an antenna structure 1730 (e.g., the antenna structure 800 in FIG. 8 or the antenna structure 1400 in FIG. 14) capable of transmitting and/or receiving signals having vertical and horizontal polarizations, an antenna structure 1731 capable of transmitting and/or receiving a signal having horizontal polarization, or an antenna structure 1732 (e.g., the antenna structure 500 in FIG. 5A or the antenna structure 600 in FIG. 11A) capable of transmitting and/or receiving a signal having vertical polarization.

Referring to FIG. 17A, the wireless communication circuit 1710 (e.g., the wireless communication circuit 595 in FIG. 5B) may be electrically connected to the antenna structure 1730 through a first electrical connection member 1720.

Referring to FIGS. 17B and 17C, the wireless communication circuit 1710 may be electrically connected to the antenna structure 1731 capable of transmitting and/or receiving a signal having horizontal polarization through a second electrical connection member 1721 and also electrically connected to the antenna structure 1732 capable of transmitting and/or receiving a signal having vertical polarization through a third electrical connection member 1722. In this case, the two electrical connection members 1721 and 1722 may be disposed at least partially overlapped with each other as shown in FIG. 17B, or may be disposed in parallel with each other as shown in FIG. 17C. In another embodiment, the two antenna structures 1731 and 1732 may be disposed at different positions of one electrical connection member 1721 or 1722. The arrangement of the electrical connection members 1721 and 1722 may be determined based on efficient layout design of the antenna structure in the inner space of the electronic device (e.g., the electronic device 1800 in FIG. 18). According to an embodiment, each of the electrical connection members 1720, 1721, and 1722 may be or include an FPCB-type RF cable (FRC) or a coaxial cable.

Figure 18A:
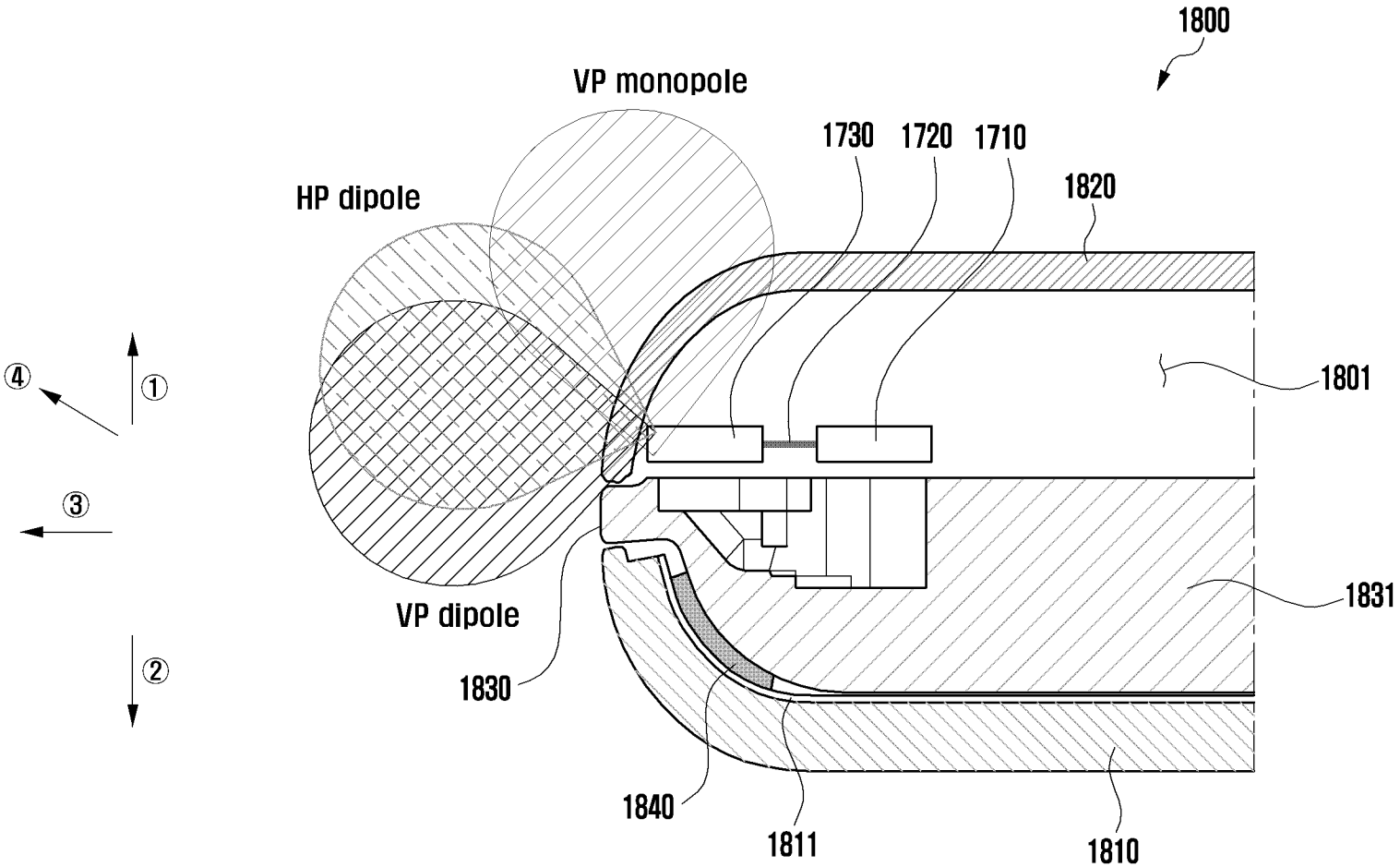
FIGS. 18A and 18B are cross-sectional views partially showing an electronic device including an antenna structure according to certain embodiments of the disclosure.
Figure 18B:
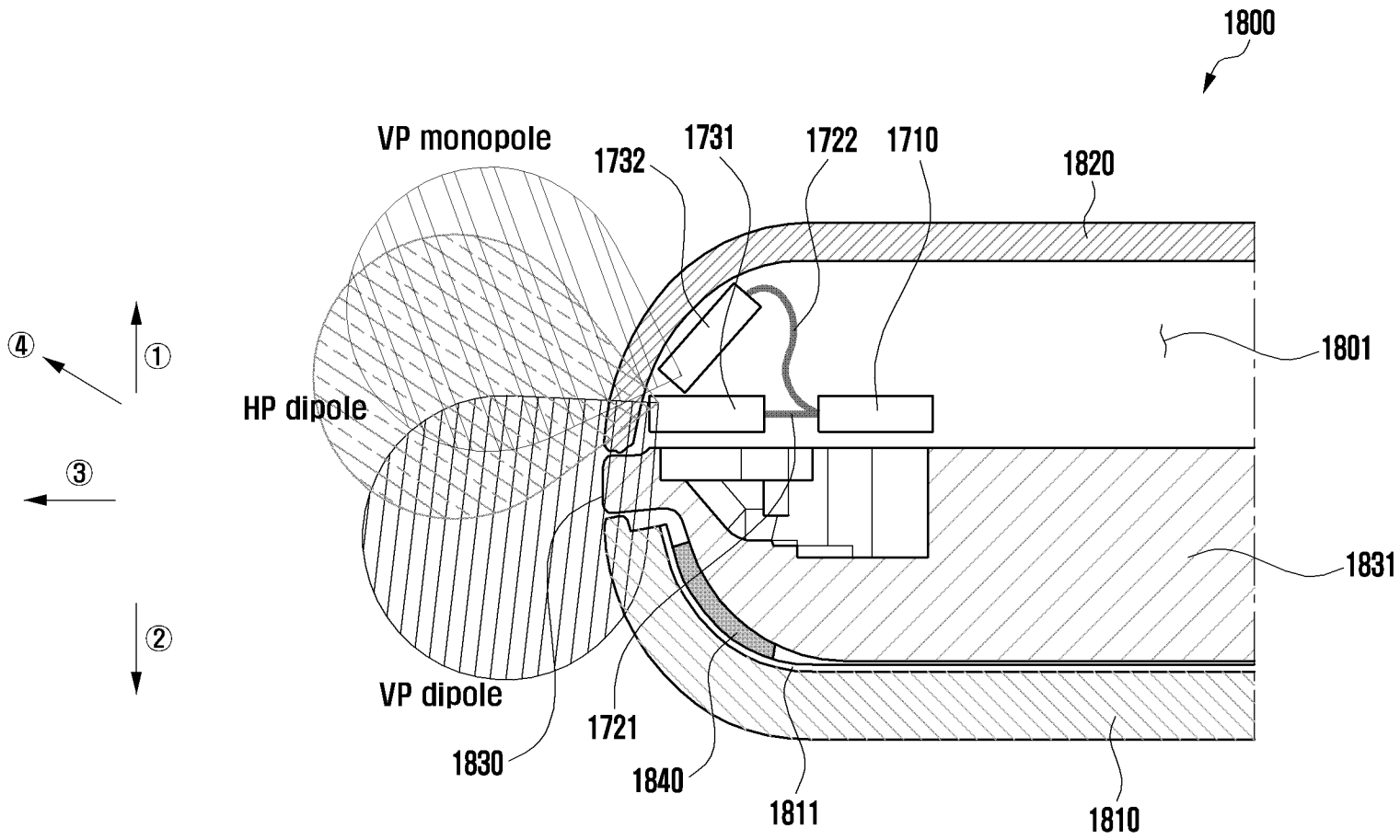

FIGS. 18A and 18B are cross-sectional views partially showing an electronic device including an antenna structure according to certain embodiments of the disclosure.

The electronic device 1800 of FIGS. 18A and 18B may be similar at least in part to the electronic device 101 of FIG. 1 or the electronic device 300 of FIG. 3A or may further include other embodiments of the electronic device.

FIG. 18A is a cross-sectional view partially showing the electronic device 1800 including the antenna structure 1730 of FIG. 17A disposed in the inner space 1801. According to an embodiment, the electronic device 1800 may include a front cover 1810 (e.g., front plate, first plate, or glass plate), a rear cover 1820 (e.g., rear plate or second plate) facing opposite to the front cover 1810, and a lateral member 1830 surrounding the inner space 1801 between the front cover 1810 and the rear cover 1820. According to an embodiment, at least a portion of the lateral member 1830 may form a support structure 1831 extended into the inner space 1801. According to an embodiment, the electronic device 1800 may include a display 1811 disposed in the inner space 1801 to be visible from the outside through the front cover 1810. The front cover 1810 may be attached to at least a portion of the lateral member 1830 through an adhesive member 1840. According to an embodiment, the antenna structure 1730 and the wireless communication circuit 1710 may be disposed to be supported by at least a portion of the support structure 1831.

According to an embodiment, the electronic device 1800 may include the antenna structure 1730 (e.g., the antenna structure 800 in FIG. 8 or the antenna structure 1400 in FIG. 14) disposed near the lateral member 1830 in the inner space 1801. For example, the antenna structure 1730 may be disposed to form a beam pattern, through at least one antenna generating horizontal polarization, in a boresight direction (denoted by ③) that the lateral member 1830 faces. In this case, if at least one antenna generating vertical polarization is a monopole antenna (e.g., the first antenna array AR1 in FIG. 8), a beam pattern may be formed in a direction (e.g., denoted by ④) tilted at a certain angle from the boresight direction that the lateral member 1830 faces. In another embodiment, if the antenna generating vertical polarization is a dipole antenna (e.g., the first antenna array AR1 in FIG. 14), a beam pattern may be formed in the boresight direction (denoted by ③) that the lateral member 1830 faces, like the antenna structure for horizontal polarization FIG. 18B is a cross-sectional view partially showing the electronic device 1800 including the antenna structures 1731 and 1732 of FIG. 17B or 17C disposed in the inner space 1801. Referring to FIG. 18B, the antenna structure 1731 may be disposed to form a beam pattern, through at least one antenna generating horizontal polarization, in a boresight direction (denoted by ③) that the lateral member 1830 faces. According to an embodiment, at least one antenna generating vertical polarization may be a monopole antenna, and the antenna structure 1732 may be disposed to have a slope as shown in FIG. 18B to compensate for the tilted angle in the inner space 1801 of the electronic device 1800 in order to form a beam pattern in the same direction as the antenna structure 1731. For example, antenna structures 1730, 1731, and 1732 having different polarizations may be disposed in the inner space of the electronic device in consideration of the directivity of the beam pattern.

FIGS. 19A to 19D are cross-sectional views partially illustrating an electronic device 1900 including an antenna structure 1940 or 1950 according to certain embodiments of the disclosure.

The electronic device 1900 of FIGS. 19A to 19D may be similar at least in part to the electronic device 101 of FIG. 1 or the electronic device 300 of FIG. 3A or may further include other embodiments of the electronic device.

Figure 19A:
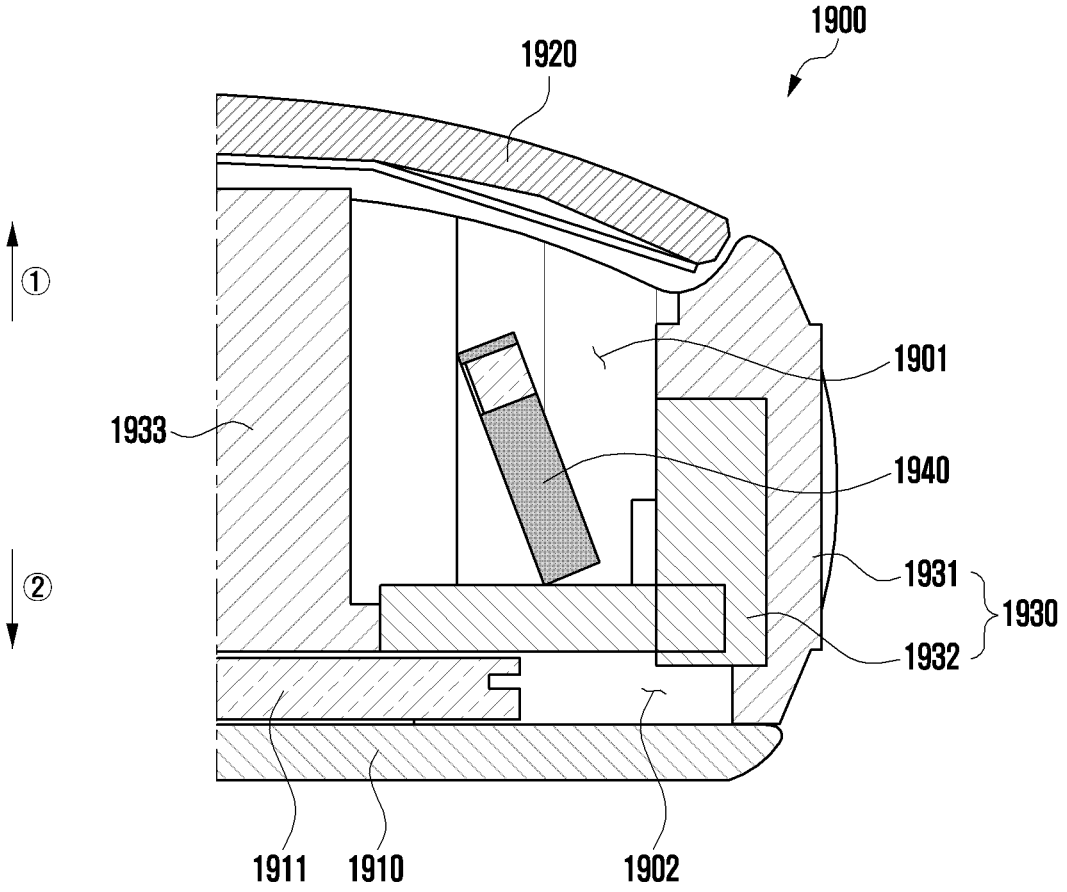
FIGS. 19A to 19D are cross-sectional views partially illustrating an electronic device including an antenna structure according to certain embodiments of the disclosure.

FIG. 19A is a cross-sectional view partially illustrating a state where the antenna structure 1940 (e.g., the antenna structure 600 in FIG. 11A) is disposed in an inner space 1901 of the electronic device 1900.

Referring to FIG. 19A, the electronic device 1900 may include a front cover 1910 (e.g., front plate, first plate, or glass plate), a rear cover 1920 (e.g., rear plate or second plate) facing opposite to the front cover 1910, and a lateral member 1930 surrounding the inner space 1901 between the front cover 1910 and the rear cover 1920. According to an embodiment, the lateral member 1930 may have a conductive portion 1931 (e.g., a metal member) and a non-conductive portion 1932 (e.g., a polymer member) combined with the conductive portion 1931. According to an embodiment, the lateral member 1930 may have a support structure 1933 extended into the inner space 1901 and supporting the antenna structure 1940. According to an embodiment, the electronic device 1900 may include a display 1911 disposed in the inner space 1901 to be visible from the outside through the front cover 1910. According to an embodiment, the antenna structure 1940 may be disposed to form a beam pattern from the inner space 1901 toward the front cover 1910 through a space 1902 (e.g., the black matrix (BM) area) between the display 1911 and the conductive portion 1931 of the lateral member 1930. For example, the antenna structure 1940 may be disposed in the inner space 1901 to be inclined at a certain angle so that the beam pattern is directed to the space 1902 between the display 1911 and the lateral member 1930. For example, the antenna structure 1940 may include a dipole antenna (e.g., the first antenna 610 or the second antenna 620 in FIGS. 11A to 11D) configured to transmit and/or receive signals having vertical polarization.

Figure 19B:
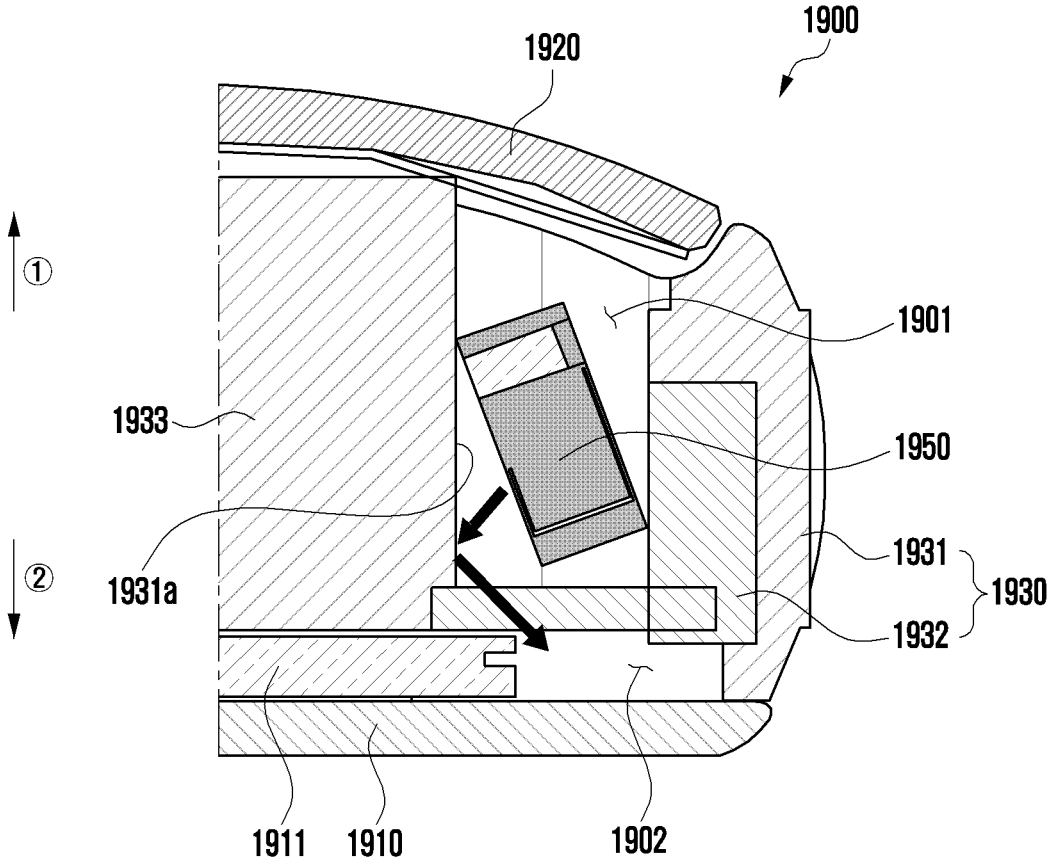
Figure 19C:
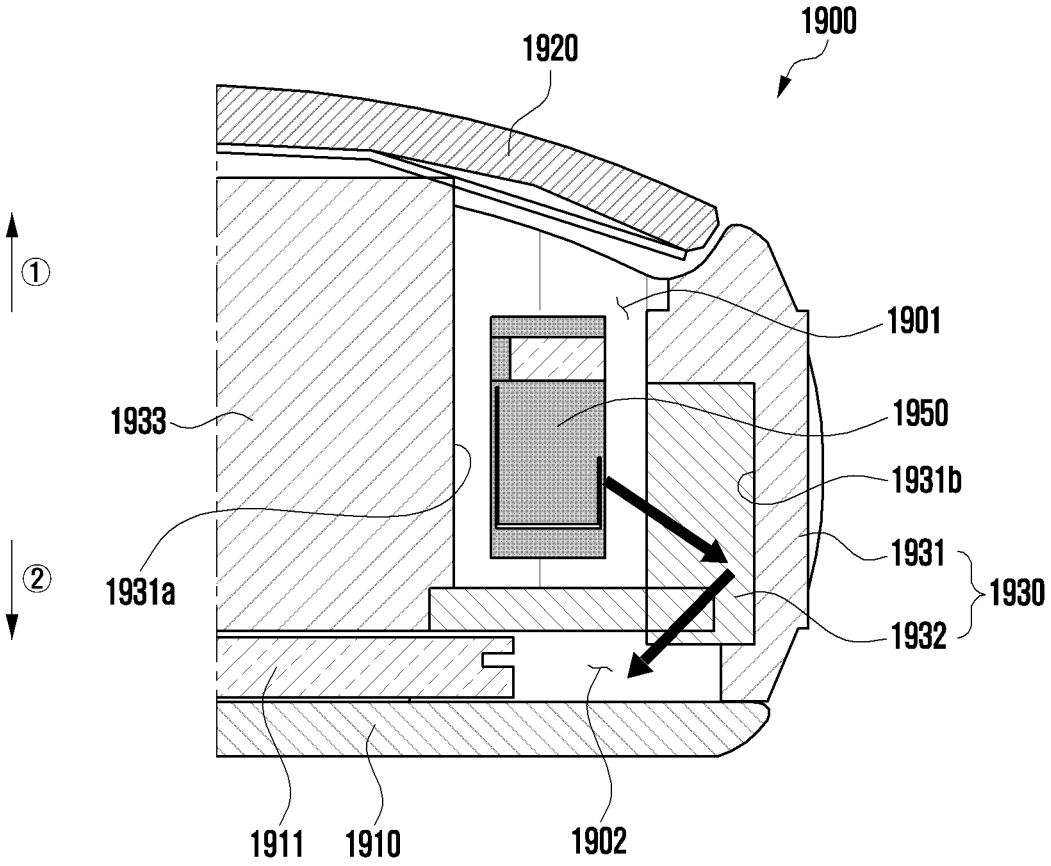
Figure 19D:
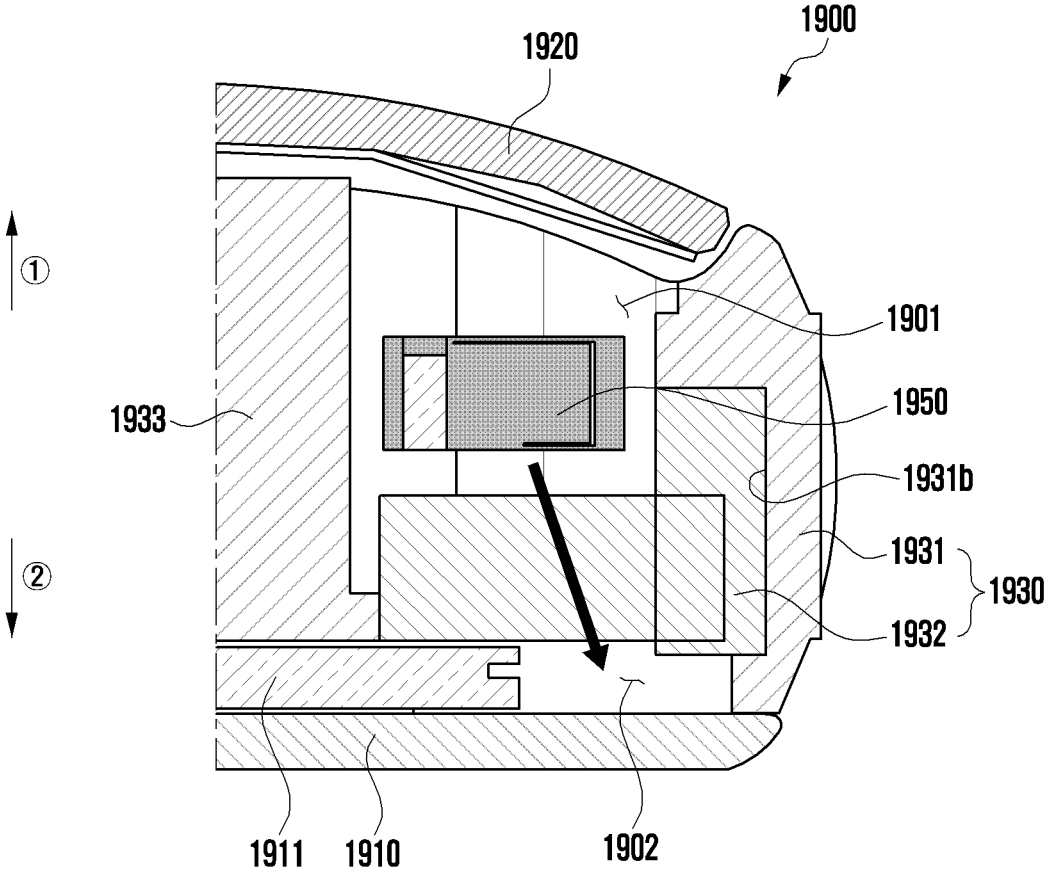

FIGS. 19B to 19D illustrate a state where the antenna structure 1950 (e.g., the antenna structure 500 in FIG. 5A) is disposed in the inner space of the electronic device. For example, the antenna structure 1950 may include a monopole antenna (e.g., the antenna 510 in FIG. 5A) configured to transmit and/or receive signals having vertical polarization.

Referring to FIG. 19B, the antenna structure 1950 may be disposed in the inner space 1901 of the electronic device 1900 such that a beam pattern is reflected by a first inner surface 1931*a* of the conductive portion 1931 and then proceeds toward the space 1902 between the display 1911 and the lateral member 1930.

Referring to FIG. 19C, the antenna structure 1950 may be disposed in the inner space 1901 of the electronic device 1900 such that a beam pattern is reflected by a second inner surface 1931*b* of the conductive portion 1931 and then proceeds toward the space 1902 between the display 1911 and the lateral member 1930.

Referring to FIG. 19D, the antenna structure 1950 may be disposed in the inner space 1901 of the electronic device 1900 such that a beam pattern is formed toward the space 1902 between the display 1911 and the lateral member 1930 without reflection by the conductive portion 1931.

Figure 20:
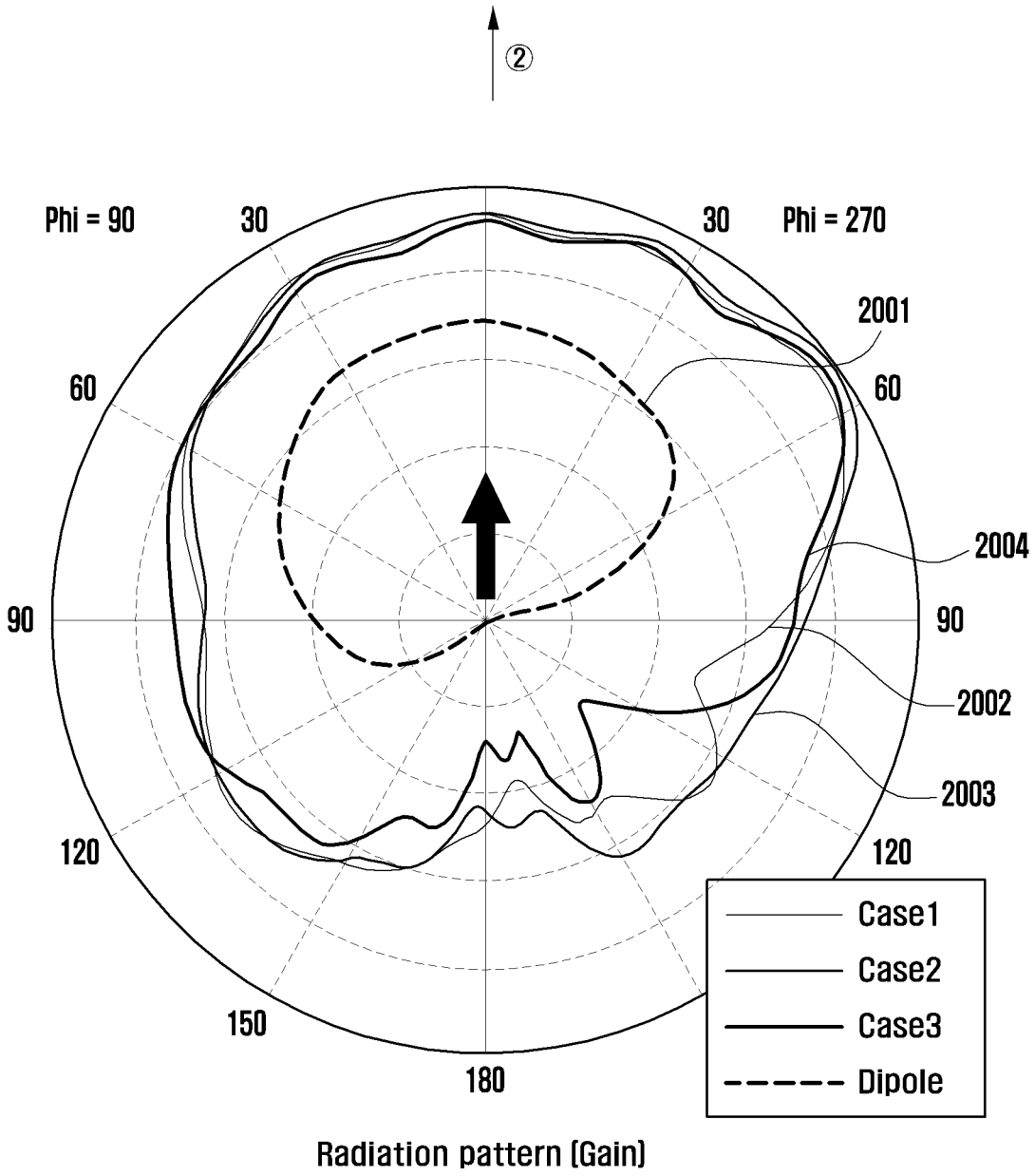
FIG. 20 is a graph showing radiation patterns of the antenna structure shown in FIGS. 19A to 19D according to certain embodiments of the disclosure.

FIG. 20 is a graph showing radiation patterns of the antenna structures shown in FIGS. 19A to 19D according to certain embodiments of the disclosure.

Referring to FIG. 20, in case where the antenna structure 1940 including a dipole antenna configured to transmit and/or receive signals having vertical polarization is disposed (graph 2001), and in cases where the antenna structure 1950 including a monopole antenna configured to transmit and/or receive signals having vertical polarization is disposed in various ways (graphs 2002, 2003, and 2004), there is a difference in the efficiency of the radiation pattern, but all radiation patterns have similar directivity in the direction towards the front plate 1910.

As described above, the antenna structure according to certain embodiments of the disclosure has a reduced size and realizes radiation away from the board lateral surface of the PCB. In addition, the antenna structure may be disposed in various ways in the inner space of the electronic device, thereby contributing to the slimming of the electronic device.

According to an embodiment, an electronic device (e.g., the electronic device 300 in FIG. 3A) may include a housing (e.g., the housing 310 in FIG. 3A) having an inner space, an antenna structure (e.g., the antenna structure 500 in FIG. 5A) disposed in the inner space of the housing, and a wireless communication circuit (e.g., the wireless communication circuit 595 in FIG. 5B) disposed in the inner space of the housing. The antenna structure may include a printed circuit board (PCB) (e.g., the PCB 590 in FIG. 5A) and at least one antenna (e.g., the antenna 510 in FIG. 5A) disposed in the PCB. The PCB may have a first board surface (e.g., the first board surface 591 in FIG. 5A) facing a first direction (e.g., denoted by ① in FIG. 5A), a second board surface (e.g., the second board surface 592 in FIG. 5A) facing a second direction (denoted by ② in FIG. 5A) opposite to the first direction, a board lateral surface (e.g., the board lateral surface 593 in FIG. 5A) surrounding a space between the first and second board surfaces, a plurality of insulating layers (e.g., the insulating layers 5901 in FIG. 5A), and a ground layer (e.g., the ground layer 5903 in FIG. 5A). The at least one antenna may be overlapped with the ground layer when the first board surface is viewed from above, and may form a beam pattern in a direction that the board lateral surface faces. The at least one antenna may include a conductive line (e.g., the conductive line 511 in FIG. 5A) disposed on a first insulating layer among the plurality of insulating layers, a conductive via (e.g., the conductive via 512 in FIG. 5A) extended from the conductive line in the first direction, and at least one conductive pattern (e.g., the conductive pattern(s) 513 and/or 514 in FIG. 5A) branched at a right angle from the conductive line on the first insulating layer. The wireless communication circuit may be configured to transmit and/or receive a radio signal in a range of about 3 GHz to about 100 GHz through the at least one antenna.

According to an embodiment, the at least one conductive pattern may include a first conductive pattern (e.g., the first conductive pattern 513 in FIG. 5A) having a first length and extended from the conductive line in one direction, and a second conductive pattern (e.g., the second conductive pattern 514 in FIG. 5A) having a second length and extended from the conductive line in another direction opposite to the one direction.

According to an embodiment, the first conductive pattern and the second conductive pattern may have substantially same length and/or shape.

According to an embodiment, the at least one antenna may have impedance characteristics determined based on lengths of the first and second conductive patterns.

According to an embodiment, the at least one antenna may further include a third conductive pattern (e.g., the third conductive pattern 515 in FIG. 5A) extended from one end of the conductive via in a direction parallel with the conductive line.

According to an embodiment, the third conductive pattern may be disposed to be overlapped at least in part with the conductive line when the first board surface is viewed from above.

According to an embodiment, the antenna structure may further include a pair of conductive walls (e.g., the conductive walls 516 and 517 in FIG. 5A) disposed symmetrically with respect to the conductive line interposed therebetween when the first board surface is viewed from above.

According to an embodiment, the pair of conductive walls may be disposed between the conductive line and the third conductive pattern when the board lateral surface is viewed from side.

According to an embodiment, the at least one antenna may have impedance characteristics determined based on lengths of the pair of conductive walls.

According to an embodiment, the housing may include a front cover on which a display is disposed, a rear cover facing opposite to the front cover, and a lateral member surrounding the inner space between the front cover and the rear cover, and the antenna structure may be disposed to form a beam pattern in a direction that the rear cover faces, a direction that the front cover faces, and/or a direction that the lateral member faces.

According to an embodiment, an electronic device (e.g., the electronic device 300 in FIG. 3A) may include a housing (e.g., the housing 310 in FIG. 3A) having an inner space, an antenna structure (e.g., the antenna structure 600 in FIG. 11A) disposed in the inner space of the housing, and a wireless communication circuit (e.g., the wireless communication circuit 595 in FIG. 11B) disposed in the inner space of the housing. The antenna structure may include a printed circuit board (PCB) (e.g., the PCB 590 in FIG. 11A) and at least one first antenna (e.g., the first antenna 610 in FIG. 11B) disposed in the PCB. The PCB may have a first board surface (e.g., the first board surface 591 in FIG. 11A) facing a first direction (e.g., denoted by ① in FIG. 11A), a second board surface (e.g., the second board surface 592 in FIG. 11A) facing a second direction (denoted by ② in FIG. 11A) opposite to the first direction, a board lateral surface (e.g., the board lateral surface 593 in FIG. 11A) surrounding a space between the first and second board surfaces, and a plurality of insulating layers. The at least one first antenna may form a beam pattern in a direction that the board lateral surface faces, and may include a first antenna element (e.g., the first antenna element 611 in FIG. 11B) and a second antenna element (e.g., the second antenna element 612 in FIG. 11B). The first antenna element may include a first conductive line (e.g., the first conductive line 6111 in FIG. 11B) disposed on a first insulating layer among the plurality of insulating layers, a first conductive via (e.g., the first conductive via 6112 in FIG. 11B) extended from the first conductive line in the first direction, and a first conductive pattern (e.g., the first conductive pattern 6113 in FIG. 11B) extended from the first conductive via. The second antenna element may include a second conductive line (e.g., the second conductive line 6121 in FIG. 11B) disposed on a second insulating layer among the plurality of insulating layers, a second conductive via (e.g., the second conductive via 6122 in FIG. 11B) extended from the second conductive line in the second direction, and a second conductive pattern (e.g., the second conductive pattern 6123 in FIG. 11B) extended from the second conductive via. The wireless communication circuit may be configured to transmit and/or receive a radio signal of a first frequency band through the at least one first antenna.

According to an embodiment, when the first board surface is viewed from above, the first conductive line, the second conductive line, the first conductive pattern, and the second conductive pattern may be overlapped with each other at least in part respectively.

According to an embodiment, when the first board surface is viewed from above, the first conductive via and the second conductive via may be disposed to be overlapped with each other.

According to an embodiment, the first antenna element may further include at least one first conductive stub (e.g., the first conductive stub 6114 in FIG. 11B) having a first length and extended from the first conductive line in the first direction, and the second antenna element may further include at least one second conductive stub (e.g., the second conductive stub 6124 in FIG. 11B) having a second length and extended from the second conductive line in the second direction. When the first board surface is viewed from above, the first conductive stub and the second conductive stub may be disposed to be overlapped with each other.

According to an embodiment, the antenna structure may further include at least one second antenna (e.g., the second antenna 620 in FIG. 11B) including a third antenna element (e.g., the third antenna element 621 in FIG. 11B) and a fourth antenna element (e.g., the fourth antenna element 622 in FIG. 11B). The third antenna element may include a first conductive extension pattern (e.g., the first conductive extension pattern 6211 in FIG. 11B) extended from the first conductive line on the first insulating layer, and a third conductive via (e.g., the third conductive via 6212 in FIG. 11B) extended from the first conductive extension pattern in the first direction to be parallel with the first conductive via. The fourth antenna element may include a second conductive extension pattern (e.g., the second conductive extension pattern 6221 in FIG. 11B) extended from the second conductive line on the second insulating layer, and a fourth conductive via (e.g., the fourth conductive via 6222 in FIG. 11B) extended from the second conductive extension pattern in the second direction to be parallel with the second conductive via.

According to an embodiment, the wireless communication circuit may be further configured to transmit and/or receive a radio signal of a second frequency band lower than the first frequency band through the at least one second antenna.

According to an embodiment, when the first board surface is viewed from above, the first conductive extension pattern and the second conductive extension pattern may be disposed to be overlapped with each other.

According to an embodiment, when the first board surface is viewed from above, the third conductive via and the fourth conductive via may be disposed to be overlapped with each other.

According to an embodiment, the housing may include a front cover on which a display is disposed, a rear cover facing opposite to the front cover, and a lateral member surrounding the inner space between the front cover and the rear cover, and the antenna structure may be disposed to form a beam pattern in a direction that the rear cover faces, a direction that the front cover faces, and/or a direction that the lateral member faces.

According to an embodiment, an electronic device (e.g., the electronic device 300 in FIG. 3A) may include a housing (e.g., the housing 310 in FIG. 3A) having an inner space, an antenna structure (e.g., the antenna structure 1400 in FIG. 14) disposed in the inner space of the housing, and a wireless communication circuit (e.g., the wireless communication circuit 595 in FIG. 11B) disposed in the inner space of the housing. The antenna structure may include a printed circuit board (PCB) (e.g., the PCB 590 in FIG. 11A), a first antenna array (e.g., the first antenna array A1 in FIG. 14) disposed in the PCB, and a second antenna array (e.g., the second antenna array A2 in FIG. 14) disposed in the PCB. The PCB may have a first board surface (e.g., the first board surface 591 in FIG. 11A) facing a first direction (e.g., denoted by ① in FIG. 11A), a second board surface (e.g., the second board surface 592 in FIG. 11A) facing a second direction (denoted by ② in FIG. 11A) opposite to the first direction, a board lateral surface (e.g., the board lateral surface 593 in FIG. 11A) surrounding a space between the first and second board surfaces, and a plurality of insulating layers. The first antenna array may include a plurality of first antennas (e.g., the plurality of antennas A1, A2, A3, and A4 in FIG. 14) forming a beam pattern corresponding to a first polarization in a direction that the board lateral surface faces. Each of the plurality of first antennas may include a first antenna element (e.g., the first antenna element 611 in FIG. 11B) and a second antenna element (e.g., the second antenna element 612 in FIG. 11B). The first antenna element may include a first conductive line (e.g., the first conductive line 6111 in FIG. 11B) disposed on a first insulating layer among the plurality of insulating layers, a first conductive via (e.g., the first conductive via 6112 in FIG. 11B) extended from the first conductive line in the first direction, and a first conductive pattern (e.g., the first conductive pattern 6113 in FIG. 11B) extended from the first conductive via. The second antenna element may include a second conductive line (e.g., the first conductive line 6121 in FIG. 11B) disposed on a second insulating layer among the plurality of insulating layers, a second conductive via (e.g., the second conductive via 6122 in FIG. 11B) extended from the second conductive line in the second direction, and a second conductive pattern (e.g., the second conductive pattern 6123 in FIG. 11B) extended from the second conductive via. The second antenna array may include a plurality of second antennas (e.g., the plurality of antennas 810, 820, and 830 in FIG. 14) disposed respectively between the plurality of first antennas and forming a beam pattern corresponding to a second polarization different from the first polarization in the direction that the board lateral surface faces. The wireless communication circuit may be configured to transmit and/or receive a radio signal of a first frequency band through the first antenna array and the second antenna array.

Certain of the above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein.

While the disclosure has been particularly shown and described with reference to exemplary embodiments thereof, it will be understood by those skilled in the art that various changes in form and details may be made therein without departing from the scope of the subject matter as defined by the appended claims.

What is claimed is:

1. An electronic device comprising:

a housing having an inner space;

an antenna structure disposed in the inner space of the housing and including:

a printed circuit board (PCB) having a first board surface facing a first direction, a second board surface facing a second direction opposite to the first direction, a board lateral surface surrounding a space between the first and second board surfaces, a plurality of insulating layers, and a ground layer; and at least one antenna disposed in the PCB, overlapped with the ground layer when the first board surface is viewed from above, and forming a beam pattern in a direction that the board lateral surface faces, wherein the at least one antenna includes:

a conductive line disposed on a first insulating layer among the plurality of insulating layers;

a first conductive pattern having a first length and extended from a first end of the conductive line in one direction;

a second conductive pattern having a second length and extended from a second end opposite the first end of the conductive line in another direction opposite to the one direction; and a conductive via extended from an intersection of the conductive line and the first conductive pattern in the first direction; and a wireless communication circuit disposed in the inner space of the housing and configured to transmit and/or receive a radio signal through the at least one antenna.

2. The electronic device of claim 1, wherein the first conductive pattern and the second conductive pattern have substantially same length and/or shape.

3. The electronic device of claim 1, wherein the at least one antenna has impedance characteristics determined based on lengths of the first and second conductive patterns.

4. The electronic device of claim 1, wherein the at least one antenna further includes a third conductive pattern extended from one end of the conductive via in a direction parallel with the conductive line.

5. The electronic device of claim 4, wherein the third conductive pattern is disposed to be overlapped at least in part with the conductive line when the first board surface is viewed from above.

6. The electronic device of claim 4, wherein the antenna structure further includes a pair of conductive walls disposed symmetrically with respect to the conductive line interposed therebetween when the first board surface is viewed from above.

7. The electronic device of claim 6, wherein the pair of conductive walls are disposed between the conductive line and the third conductive pattern when the board lateral surface is viewed from side.

8. The electronic device of claim 6, wherein the at least one antenna has impedance characteristics determined based on lengths of the pair of conductive walls.

9. The electronic device of claim 1, wherein the housing includes a front cover on which a display is disposed, a rear cover facing opposite to the front cover, and a lateral member surrounding the inner space between the front cover and the rear cover, and wherein the antenna structure is disposed to form a beam pattern in a direction that the rear cover faces, a direction that the front cover faces, and/or a direction that the lateral member faces.

* * * * *